US008734564B2

(12) United States Patent
Kim et al.

(10) Patent No.: US 8,734,564 B2
(45) Date of Patent: May 27, 2014

(54) MAGNESIUM-BASED ALLOY WITH SUPERIOR FLUIDITY AND HOT-TEARING RESISTANCE AND MANUFACTURING METHOD THEREOF

(75) Inventors: Shae K. Kim, Seoul (KR); Jung-Ho Seo, Seoul (KR)

(73) Assignee: Korea Institute of Industrial Technology, Cheonan (KR)

( * ) Notice: Subject to any disclaimer, the term of this patent is extended or adjusted under 35 U.S.C. 154(b) by 429 days.

(21) Appl. No.: 13/071,141

(22) Filed: Mar. 24, 2011

(65) Prior Publication Data

US 2011/0236249 A1 Sep. 29, 2011

(30) Foreign Application Priority Data

Mar. 29, 2010 (KR) ..... 10-2010-0028134
Mar. 29, 2010 (KR) ..... 10-2010-0028163
Dec. 23, 2010 (KR) ..... 10-2010-0133880

(51) Int. Cl.
*C22C 23/00* (2006.01)
*C22C 1/02* (2006.01)

(52) U.S. Cl.
USPC ..... 75/420; 428/604; 420/590; 148/420

(58) Field of Classification Search
USPC ..... 148/420; 420/402; 428/604
See application file for complete search history.

(56) References Cited

U.S. PATENT DOCUMENTS 4,705,561 A 11/1987 Green
4,786,322 A * 11/1988 Green ..... 75/312
8,349,050 B2 * 1/2013 Kim et al. ..... 75/315

FOREIGN PATENT DOCUMENTS

JP 4467641 B2 3/2010
KR 1020060094734 A 8/2006
KR 1020090071903 A 7/2009
WO WO 2010/032893 A1 3/2010

OTHER PUBLICATIONS

Jin-Kyu Lee et al., "Development of Eco-Mg Alloy", Journal of the Korean Foundrymen's Society, Jun. 2009, vol. 29 No. 3.

* cited by examiner

*Primary Examiner* — George Wyszomierski
*Assistant Examiner* — Tima M McGuthry Banks

(57) ABSTRACT

Provided are a magnesium-based alloy and a manufacturing method thereof. In the method, a magnesium alloy is melted into liquid phase, and an alkaline earth metal oxide is added into a molten magnesium alloy. The alkaline earth metal oxide is exhausted through surface reduction reaction between the melt and the alkaline earth metal oxide. Alkaline earth metal produced by the exhaustion reacts with Mg and/or other alloying elements in the magnesium alloy so that an intermetallic compound is formed. The magnesium prepared by the method is excellent in fluidity and hot-tearing resistance. To this end, the alkaline earth metal oxide added is CaO, and the added amount of CaO is 1.4 to 1.7 times the target weight of Ca to be contained in the final Mg alloy.

22 Claims, 26 Drawing Sheets

| | | AZ31 | 0.1Ca | 0.3Ca | 0.5Ca | 0.7Ca | 0.9Ca |
|---|---|---|---|---|---|---|---|
| AZ31-Ca | PRIMARY CASTING |  | | | | | |
| | | 35cm | 34.5cm | 27.5cm | 30cm | 32cm | 24.5cm |
| | SECONDARY CASTING |  | | | | | |
| | | 32cm | 29.5cm | 32cm | 29.5cm | 27cm | 29.5cm |

| | | AZ31 | 0.1CaO | 0.3CaO | 0.5CaO | 0.7CaO | 0.9CaO |
|---|---|---|---|---|---|---|---|
| AZ31-CaO | PRIMARY CASTING |  | | | | | |
| | | 36.5cm | 36.5cm | 35cm | 42cm | 43cm | 44cm |
| | SECONDARY CASTING |  | | | | | |
| | | 31.5cm | 39cm | 41.5cm | 39cm | 44.5cm | 45.5cm |

(a)

(b)

| COMPOSITION | CRACK LOCATIONS AND WIDTHS | RELATIONS | | | |
|---|---|---|---|---|---|
| | | Sprue end | Rod center | Ball end | TOTAL |
| AZ31 |  | 0.3×32×1 | | | 9.6 |
| | | 0.3×16×1 | | | 4.8 |
| | | | 1.2×8×3 | | 28.8 |
| | | 0.3×4×1 | 1.2×4×3 | | 15.6 |
| | | TOTAL | | | 58.8 |
| AZ31-0.1Ca |  | | | | |
| | | 0.2×16×1 | 0.5×16×3 | | 27.2 |
| | | 0.3×8×1 | | 1.0×8×2 | 18.4 |
| | | 1.6×4×1 | | 0.3×4×2 | 8.8 |
| | | TOTAL | | | 54.4 |
| AZ31-0.3Ca |  | 0.2×32×1 | | | 6.4 |
| | | 0.8×16×1 | | 0.1×16×2 | 16 |
| | | 1.3×8×1 | 0.3×8×3 | | 17.6 |
| | | 0.5×4×1 | | 1.0×4×2 | 10 |
| | | TOTAL | | | 50 |
| AZ31-0.5Ca |  | 0.3×32×1 | | | 9.6 |
| | | 0.5×16×1 | | 0.1×16×2 | 11.2 |
| | | 0.1×8×1 | | 0.8×8×2 | 13.6 |
| | | | 1.2×4×3 | | 14.4 |
| | | TOTAL | | | 48.8 |
| AZ31-0.7Ca |  | 0.3×32×1 | | | 9.6 |
| | | 0.5×16×1 | | | 8 |
| | | | | 1.0×8×2 | 16 |
| | | 0.2×4×1 | | 1.5×4×2 | 12.8 |
| | | TOTAL | | | 46.4 |
| AZ31-0.9Ca |  | 0.3×32×1 | | | 9.6 |
| | | 0.4×16×1 | | | 6.4 |
| | | 1.1×8×1 | | 0.2×8×2 | 12 |
| | | 1.5×4×1 | | 0.2×4×2 | 7.6 |
| | | TOTAL | | | 35.6 |

| COMPOSITION | CRACK LOCATIONS AND WIDTHS | RELATIONS | | | |
|---|---|---|---|---|---|
| | | Sprue end | Rod center | Ball end | TOTAL |
| AZ31 |  | 0.2×32×1 | | | 6.4 |
| | | 1.2×16×1 | | 0.3×16×2 | 28.8 |
| | | 1.3×8×1 | | 0.3×8×2 | 15.2 |
| | | 1.0×4×1 | | 0.4×4×2 | 7.2 |
| | | TOTAL | | | 57.6 |
| AZ31-0.1CaO |  | | | | |
| | | | 0.5×16×3 | | 24 |
| | | 0.1×8×1 | 0.6×8×3 | | 15.2 |
| | | 0.7×4×1 | | 1.1×4×2 | 11.6 |
| | | TOTAL | | | 50.8 |
| AZ31-0.3CaO |  | 0.1×32×1 | | | 3.2 |
| | | 0.5×16×1 | | 0.1×16×2 | 11.2 |
| | | 0.1×8×1 | | 1.0×8×2 | 16.8 |
| | | 1.6×4×1 | | 0.1×4×2 | 7.2 |
| | | TOTAL | | | 38.4 |
| AZ31-0.5CaO |  | 0.1×32×1 | | | 3.2 |
| | | 0.3×16×1 | | | 4.8 |
| | | 0.1×8×1 | | 0.6×8×2 | 10.4 |
| | | | | 1.6×4×2 | 12.8 |
| | | TOTAL | | | 31.2 |
| AZ31-0.7CaO |  | 0.1×32×1 | | | 3.2 |
| | | 0.3×16×1 | | 0.1×16×2 | 8 |
| | | 0.6×8×1 | | 0.1×8×2 | 6.4 |
| | | | | 1.0×4×2 | 8 |
| | | TOTAL | | | 25.6 |
| AZ31-0.9CaO |  | | | | |
| | | | | 0.2×16×2 | 6.4 |
| | | | | 0.5×8×2 | 8 |
| | | 1.1×4×1 | | 0.1×4×2 | 5.2 |
| | | TOTAL | | | 19.6 |

MAGNESIUM-BASED ALLOY WITH SUPERIOR FLUIDITY AND HOT-TEARING RESISTANCE AND MANUFACTURING METHOD THEREOF

BACKGROUND OF THE INVENTION

1. Field of the Invention

The present invention relates to a magnesium-based alloy with superior fluidity and hot-tearing resistance, and a manufacturing method thereof.

2. Description of the Prior Art

Generally, since magnesium alloy or magnesium is the lightest element among commercially available metals and is excellent in specific strength and specific stiffness, it is being expected as a light structure material.

Magnesium with a specific gravity of 1.7 is not only the lightest element among commercially available metals, but its specific strength and specific stiffness are also superior to those of iron and aluminum. In addition, excellent mechanical properties can be obtained when manufacturing magnesium products by a die casting process. Therefore, magnesium is currently being applied to various fields, such as portable electronic components, aircrafts and sporting goods, etc., with mainly focusing on the field of automobile components. When magnesium alloys are applied to the automobile components, 30% of a weight reduction can be achieved.

Typical magnesium alloys among the currently available commercial magnesium alloys for die casting applications are magnesium (Mg)-aluminum (Al) based alloys such as AZ91D, AM50 and AM60. Properties required for magnesium alloy are corrosion resistance and oxidation resistance as well as castability suitable for die casting. Moreover, when considering competitiveness against steel and aluminum, development of magnesium alloys excluding high-priced additive elements is required in terms of cost.

Magnesium alloys which have been developed based on the above requirements are disadvantageous in cost in the case where an addition ratio of a rare earth element (RE) is increased. On the other hand, when adding alkaline earth metals (e.g., calcium (Ca) and strontium (Sr)) into magnesium alloys, there is a problem that the magnesium alloys have poor castability such as decrease in melt fluidity, hot tear cracks, and die soldering. The price of calcium is about $200/kg, causing the manufacturing cost of magnesium alloy to be increased.

Furthermore, in the case where alkaline earth metal (Ca or Sr) is directly added into magnesium or magnesium alloy, a portion of the alkaline earth metal is dissolved in the magnesium alloy. Therefore, in order to improve physical properties of the magnesium alloy, addition of more than a certain fraction of the alkaline earth metal is required. For example, Ca should be added in an amount of 1.34 wt % or more (0.8 wt % or more in a non-equilibrium state) in order to be undissolved in a magnesium matrix and to form an intermetallic compound with magnesium or other alloying elements, wherein the intermetallic compound affects physical properties of an alloy.

SUMMARY OF THE INVENTION

An object of the present invention is to provide a magnesium-based alloy manufactured according to a new method by adding an alkaline earth metal oxide into a molten magnesium alloy, and a manufacturing method of the magnesium-based alloy.

Another object of the present invention is to provide a magnesium-based alloy capable of not only reducing or removing a protective gas but also reducing manufacturing cost using a low-priced alkaline earth metal oxide.

Another object of the present invention is to maximize the effect achieved through the addition of alloying elements by inputting an alkaline earth metal oxide and minimizing dissolution of the alkaline earth metal oxide in an alloy.

Another object of the present invention is to prevent the deterioration of melt fluidity, die soldering, and hot-tearing, which are caused by the addition of an alkaline earth metal, by indirectly adding the alkaline earth metal (e.g., Ca).

Another object of the present invention is to provide a magnesium-based alloy capable of improving mechanical properties by grain refinement and internal soundness.

Another object of the present invention is to provide a magnesium-based alloy stable for various applications by increasing oxidation resistance and ignition resistance.

Objects of the present invention are not limited to the aforesaid, and other objects not described herein will be clearly understood by those skilled in the art from descriptions below.

In accordance with an exemplary embodiment of the present invention, a magnesium-based alloy is characterized in that an alkaline earth metal oxide is wholly or partially dissociated and exhausted through reduction reaction by applying the alkaline earth metal oxide on a surface of a molten magnesium or magnesium alloy, whereby an intermetallic compound is formed by preferentially combining a metallic element of an alkaline earth metal oxide with Mg and/or other alloying elements rather than to be dissolved in the molten magnesium or magnesium alloy.

Specifically, 0.01 to 30% by weight of the alkaline earth metal oxide may be applied.

The alkaline earth metal oxide may be applied in an upper layer portion of which a depth is about 20% of a total depth of the molten magnesium or magnesium alloy from the surface thereof.

The intermetallic compound may exist in the form of at least one of a compound between the Mg and the alkaline earth metal, a compound between an alloying element of the Mg-based alloy and the alkaline earth metal, and a compound among the magnesium, the magnesium alloy and the alkaline earth metal.

In accordance with another exemplary embodiment of the present invention, a method of manufacturing a magnesium-based alloy includes: providing a melt by melting magnesium or magnesium alloy; applying an alkaline earth metal oxide on a surface of the melt; exhausting at least a portion of the alkaline earth metal oxide inside the melt through reduction reaction between the melt and the applied alkaline earth metal oxide; allowing an alkaline earth metal produced by the exhaustion of the alkaline earth metal oxide to react the magnesium and/or alloying element of the magnesium alloy; and removing the alkaline earth metal oxide remaining after the reaction together with dross.

In accordance with still another exemplary embodiment of the present invention, a method of manufacturing a magnesium-based alloy includes: providing a melt by melting magnesium or magnesium alloy; applying an alkaline earth metal oxide on a surface of the melt; exhausting the alkaline earth metal oxide not to substantially remain inside the melt through sufficient reduction reaction between the melt and the applied alkaline earth metal oxide; and reacting an alkaline earth metal produced by the exhaustion of the alkaline earth metal oxide not to substantially remain inside the magnesium alloy.

The exhausting of the alkaline earth metal oxide may further include performing the reaction until flint flashes, which is generated during the reduction reaction of the alkaline earth metal oxide, disappear.

An alkaline earth metal produced by the exhaustion of the alkaline earth metal oxide may form an intermetallic compound together with magnesium, aluminum, and other alloying elements rather than to be dissolved in the melt.

The alkaline earth metal oxide may be in the form of powders having a particle size of 0.1 to 200 μm to accelerate the reaction with the melt.

An added amount of the alkaline earth metal oxide may be 0.01 to 30.0% by weight.

The alkaline earth metal oxide may be calcium oxide

An oxygen component of the alkaline earth metal oxide may be substantially removed out from a surface of the melt by stirring an upper layer portion of the melt, and the stirring may be performed in the upper layer portion of which a depth is about 20% of a total depth of the melt from the surface thereof.

In accordance with even another exemplary embodiment of the present invention, a method of improving melt fluidity and hot-tearing resistance of a magnesium alloy includes: preparing a melt of magnesium or magnesium alloy; applying an alkaline earth metal oxide on a surface of the melt of the magnesium or magnesium alloy; and improving melt fluidity and hot-tearing resistance of the magnesium alloy by allowing the alkaline earth metal oxide applied on the melt to be reduced.

Specifically, the applied alkaline earth metal oxide may be CaO, and CaO may be applied 1.4-1.7 times the weight of a target amount of Ca in a final magnesium alloy.

The applying of the alkaline earth metal oxide on the melt may be characterized in that the alkaline earth metal oxide is reduced in an upper layer portion of which a depth is about 10% of a total depth of the melt from the surface thereof.

As described above, according to the present invention, a new magnesium-based alloy is manufactured by adding an alkaline earth metal oxide into a molten magnesium or magnesium alloy. Accordingly, it is possible to solve conventional problems arising from the direct addition of alkaline earth metal.

An alkaline earth metal oxide added into a magnesium-based alloy can be purchased at a low price, thereby reducing manufacturing cost of a magnesium alloy.

Furthermore, it is possible to reduce or remove a protective gas which is classified as a greenhouse gas, by raising an ignition temperature and prevent oxidation during the manufacture of a magnesium alloy. The reduction or removal of the protective gas enables manufacturing cost to be reduced.

In addition, an alkaline earth metal oxide added during the manufacture of a magnesium-based alloy acts as a source of alkaline earth metal so that it is not dissolved in a magnesium alloy but directly forms an intermetallic compound. Resultantly, original use of an alloy can be maintained without changes in alloy composition ratio. As another result, the addition of an alkaline earth metal oxide is helpful for improving physical properties of an alloy because an intermetallic compound exists not only at grain boundaries but also partially in grains.

Moreover, by virtue of stability of an alkaline earth metal oxide added during the manufacture of a magnesium-based alloy, the intrusion of foreign substances into a melt can be prevented during transferring or pouring of the melt, thereby improving the soundness of a magnesium alloy. Consequently, physical properties of the magnesium alloy thus manufactured can be improved.

Further, the present invention improves melt fluidity, and does not give rise to a problem such hot-tearing and die-soldering, thus making it possible to enhance castability, formability, weldability and PM processability.

BRIEF DESCRIPTION OF THE DRAWINGS

Exemplary embodiments can be understood in more detail from the following description taken in conjunction with the accompanying drawings, in which:

FIG. 5(*b*) is an enlarged view of a needle-shaped phase, and FIGS. 5(*c*) to 5(*e*) are images obtained by mapping point EDS results on Mg, Al and Ca, respectively;

DETAILED DESCRIPTION OF THE INVENTION

Figure 1:
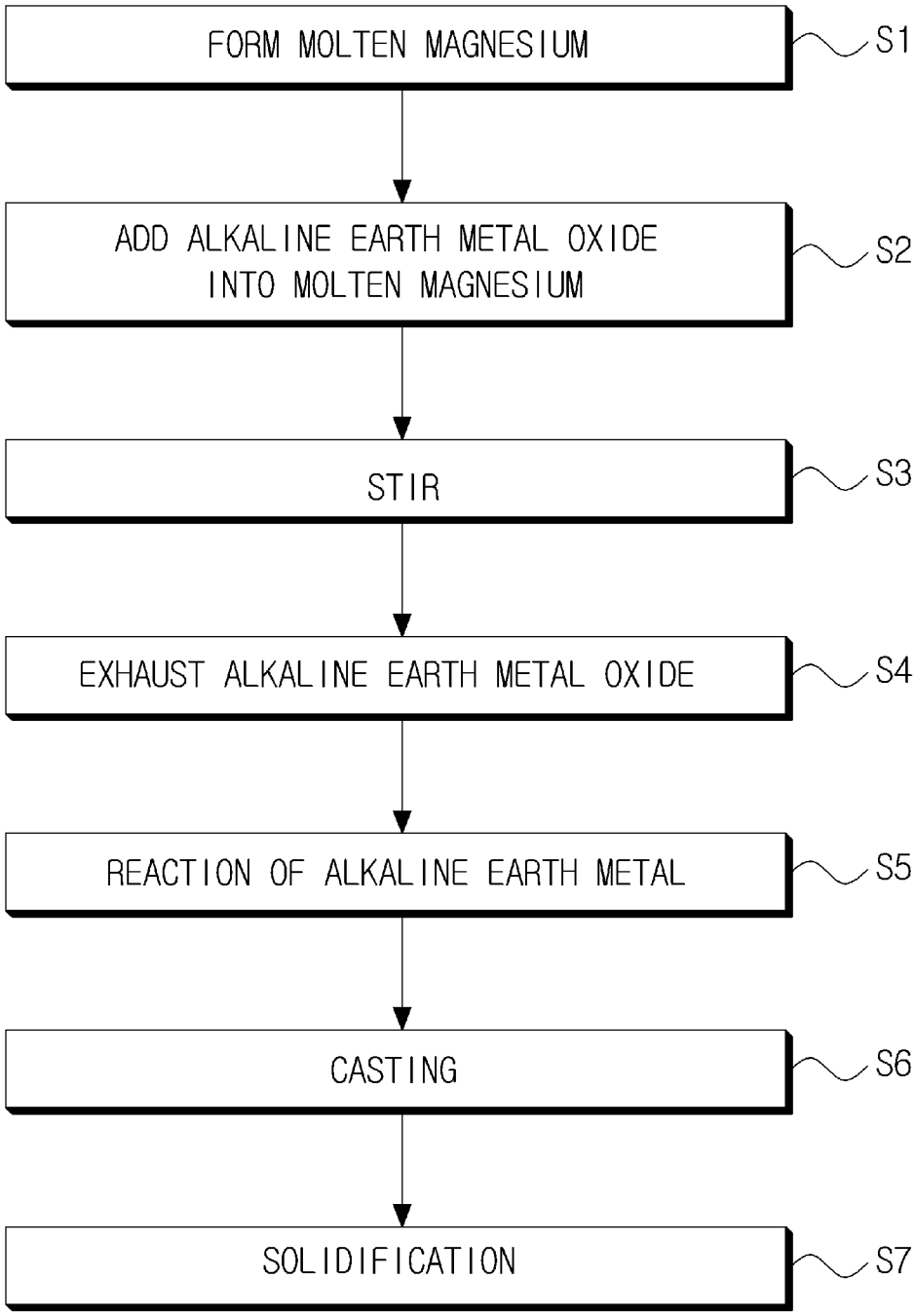
FIG. 1 is a flowchart illustrating a method of manufacturing a magnesium-based alloy according to the present invention.

Preferred embodiments of the present invention will be described below in more detail with reference to the accompanying drawings. In every possible case, like reference numerals are used for referring to the same or similar elements in the description and drawings. Moreover, detailed descriptions related to well-known functions or configurations will be ruled out in order not to unnecessarily obscure subject matters of the present invention.

In the present invention, a manufacturing method of a new alloy by adding an alkaline earth metal oxide into molten magnesium instead of alkaline earth metal and an alloy thereof are used to solve problems arising when alkaline earth metal is added to magnesium and overcome problems and limitations of physical properties.

FIG. 1 is a flowchart illustrating a method of manufacturing a magnesium-based alloy according to the present invention. As illustrated in FIG. 1, a method of manufacturing a magnesium-based alloy according to the present invention includes the steps of: forming a magnesium-based melt (S1); adding alkaline earth metal oxide (S2); stirring the magnesium-based melt (S3); exhausting the alkaline earth metal oxide (S4); allowing alkaline earth metal to react with the magnesium-based melt (S5); casting (S6); and solidifying (S7). Although step S4 of exhausting the alkaline earth metal oxide and step S5 of allowing the alkaline earth metal to react with the magnesium-based melt are divided into the separate steps for convenience of description, two steps S4 and S5 occur almost at the same time. That is, when supplying of the alkaline earth metal starts, step S5 is initiated.

In step S1 of forming the magnesium-based melt, magnesium or magnesium alloy is put into a crucible and heated at a temperature ranging from 400° C. to 800° C. under a protective gas atmosphere. Then, the magnesium alloy in the crucible is melted to form the magnesium-based melt.

—Melting Temperature of Magnesium or Magnesium Alloy

The temperature provided herein for melting magnesium or magnesium alloys means a melting temperature of pure magnesium or magnesium alloys. The melting temperature may vary with alloy type. For a sufficient reaction, an alkaline earth metal oxide is added in the state where magnesium or the magnesium alloy is completely melted. A temperature at which a solid phase is sufficiently melted to exist in a complete liquid phase is enough for the melting temperature of magnesium or the magnesium alloy. However, in the present invention, work is necessary to maintain a molten magnesium in the temperature range with sufficient margin by considering the fact that the temperature of the molten magnesium is decreased due to the addition of the alkaline earth metal oxide.

Herein, when the temperature is less than 400° C., the molten magnesium alloy is difficult to be formed. On the contrary, when the temperature is more than 800° C., there is a risk that the magnesium-based melt may be ignited. A molten magnesium is generally formed at a temperature of 600° C. or more, whereas a molten magnesium alloy may be formed at a temperature ranging from 400° C. or more to 600° C. or less. In general, many cases in metallurgy show that a melting point decreases as alloying proceeds.

When the melting temperature is increased too high, vaporization of liquid metal may occur. Also, magnesium easily ignites due to its own characteristic so that the molten magnesium may be lost and an adverse effect may be exerted on final physical properties.

The magnesium used in step S1 of forming the magnesium-based melt may be any one selected from pure magnesium, a magnesium alloy, and equivalents thereof. Also, the magnesium alloy may be any one selected from AZ91D, AM20, AM30, AM50, AM60, AZ31, AS41, AS31, AS21X, AE42, AE44, AX51, AX52, AJ50X, AJ52X, AJ62X, MRI153, MRI230, AM-HP2, magnesium-Al, magnesium-Al—Re, magnesium-Al—Sn, magnesium-Zn—Sn, magnesium-Si, magnesium-Zn—Y, and equivalents thereof; however, the present invention is not limited thereto. Any magnesium alloy that is generally available in industries may be used.

In step S2 of adding the alkaline earth metal oxide, an alkaline earth metal oxide in the form of powder is added into the molten magnesium. It is preferable that the alkaline earth metal oxide be powdered for accelerating the reaction with the magnesium alloy.

—Powder State of Alkaline Earth Metal Oxide

Any form of an alkaline earth metal oxide may be input for the reaction. Desirably, the additive may be added in a powder state so as to increase a surface area for efficient reaction. If the additive is too fine, that is, less than 0.1 μm in size, the additive is liable to be scattered by vaporized magnesium or hot wind, thereby making it difficult to input the additive into a furnace. Further, the additives are agglomerated each other, and thus clustered while not being easily mixed with liquid molten metal. On the contrary, if the powder is too coarse, it is undesirable because a total surface area is not increased. It is preferable that an ideal particle size should not exceed 500 μm. More preferably, the particle size may be 200 μm or less.

In order to prevent powder phases from being scattered, it is possible to input an alkaline earth metal oxide in the form of pellet that is agglomerated from the powder form.

—Added Alkaline Earth Metal Oxide

CaO may be typically used as an alkaline earth metal oxide added into a melt. In addition, any one selected from strontium oxide (SrO), beryllium oxide (BeO), magnesium oxide (MgO), and equivalents thereof may be used as the alkaline earth metal oxide. Alternately, mixtures thereof may be used as the alkaline earth metal oxide.

The alkaline earth metal oxide, which is used in step S2 of adding the alkaline earth metal oxide, may be added in the range of 0.001 wt % to 30 wt %. More preferably, the alkaline earth metal oxide may be added in the range of 0.001 wt % to 30 wt %. If the amount of the alkaline earth metal oxide is less than 0.001 wt %, the effect achieved by the addition of the alkaline earth metal oxide is very small.

An input amount of the alkaline earth meal oxide (CaO) is determined by a final target alloy composition. That is, an added amount of an alkaline earth metal oxide (CaO) may be determined by performing a back-calculation according to a desired amount of alkaline earth metal (Ca) to be alloyed into a magnesium alloy. Since physical properties of the magnesium alloy deviate from its original physical properties when the amount of Ca, which is indirectly alloyed into the magnesium alloy from CaO, exceeds 21.4 wt % (30 wt % in the case of CaO), the input amount of CaO is adjusted to 30 wt % or less. Preferably, it is preferable that 15.0 wt % of CaO be input by targeting the final composition of Ca at 10.7 wt %.

In the stirring step S3, the molten magnesium is stirred for 1 second to 60 minutes per 0.1 wt % of the added alkaline earth metal oxide.

Here, if the stirring time is less than 1 second/0.1 wt %, the alkaline earth metal oxide is not mixed with the molten magnesium sufficiently; and, if the stirring time is more than 60 minutes/0.1 wt %, the stirring time of the molten magnesium may be unnecessarily lengthened. In general, the stirring time depends on the volume of the molten magnesium and the input amount of alkaline earth metal oxide.

The oxide powders of a required amount may be input at once. However, to accelerate the reaction and reduce agglomeration possibility, it is preferable that the additive powders be re-input after a predetermined time elapses from a first input time, or the additive powders are grouped into several batches of appropriate amounts and the batches are input in sequence.

—Stirring Method and Conditions

It is preferable to stir the molten magnesium for the efficient reaction between the magnesium or magnesium alloy and the alkaline earth metal oxide in the present invention. The stirring may be performed by generating an electromagnetic field using a device capable of applying electromagnetic fields around the furnace holding the molten magnesium, thus enabling the convection of the molten magnesium to be induced. Also, artificial stirring (mechanical stirring) may be performed on the molten magnesium from the outside. In the case of mechanical stirring, the stirring may be performed in such a manner that the alkaline earth metal oxide powders are not agglomerated. The ultimate purpose of the stirring in the present invention is to properly induce the reduction reaction between the molten magnesium and added powders.

The stirring time may vary with the temperature of a molten magnesium and the state (pre-heating state or the like) of powders added. Preferably, the stirring may continue to be performed in principle until the powders are not observed on the surface of the molten magnesium. Since the powders are lower in specific gravity than the molten magnesium so that they float on the molten magnesium in a normal state, it can be indirectly determined that the powders and the molten magnesium sufficiently react when the powders are not observed on the molten magnesium any longer. Herein, the term 'sufficiently react' means that all of the alkaline earth metal oxide powders substantially react with the molten magnesium and are exhausted.

Although the alkaline earth metal oxide powders are not observed on the molten magnesium, possibilities of existing in the molten magnesium may not be excluded. Therefore, the CaO powders that do not float yet should be observed for a predetermined holding time after the stirring time, and the holding time is also necessary to complete the reaction of the CaO powders that did not react with the molten magnesium yet.

—Stirring Time

The stirring is effective when it is performed at the same time with the input of the oxide powders. In addition, the stirring may start after the oxide receives heat from the molten magnesium and reach a predetermined temperature or higher, which enables acceleration of the reaction. The stirring continues to be performed until the oxide powders are not observed on the surface of the molten magnesium. After the alkaline earth metal oxide is completely exhausted through the reaction, the stirring is finished.

—Surface Reaction

In general, when Ca and Sr of the alkaline earth metals are directly added into the molten magnesium, reactions occur as Ca and Sr sink into the molten magnesium having low specific gravity. Therefore, alloying may be completed by simply stirring the molten magnesium to help dissolution of Ca.

On the contrary, when an alkaline earth metal oxide is input into the molten magnesium, the alkaline earth metal oxide does not sink into the molten magnesium but floats on the surface of the molten magnesium due to a difference in specific gravity.

In the case of typical metal alloying, it is in general that reactions are forced to occur in a molten metal by inducing an active reaction by convection or stirring of the molten metal and alloying metal elements. However, in the present invention, when the reaction was induced actively, the oxide inputted into the molten magnesium could not react yet and remained in the final material so that physical properties were deteriorated or it acted as the cause of defects. That is, when the reaction was induced inside the molten magnesium instead of on the surface of the molten magnesium, there were relatively more cases where the alkaline earth metal oxide remained in the final molten magnesium rather than reacted on the surface of the molten magnesium.

In the present invention, therefore, it is important to create a reaction environment where an oxide reacts on the surface rather than inside the molten magnesium. To this end, it is important not to forcibly stir the oxide floating on the surface of the molten magnesium into the molten magnesium. It is important to uniformly spread the alkaline earth metal oxide on the molten magnesium surface exposed to air. More preferably, it is important to supply the oxide in such a way as to coat the entire surface of the molten magnesium with the oxide.

Reaction occurred better in the case of stirring the molten magnesium, and also reaction occurred better at an outer surface (surface of an upper layer portion) rather than inside the molten magnesium. That is, the molten magnesium reacted better with the oxide powders exposed to air at the outer surface (surface of an upper layer portion) thereof. However, results were not satisfactory under a state of vacuum or ambient gas. For sufficient reaction, it is necessary to induce the surface reaction through stirring of the upper layer portion. Herein, the term 'sufficiently react' means that all of the alkaline earth metal oxide react with the molten magnesium and do not remain in the molten magnesium substantially. In the present invention, the stirring inducing the foregoing surface reaction is denoted as surface stirring. That is, Ca, which is produced by reduction reaction (surface reduction reaction) of the CaO added onto the surface of the molten Mg, acts as an alloying element of Mg or Mg alloys.

In Table 1 below, after adding 5 wt %, 10 wt % and 15 wt % of calcium oxide having a particle size of 70 μm into a molten AM60B magnesium alloy, respectively, residual amounts of the calcium oxide in the magnesium alloy according to stirring methods were measured. The stirring methods used herein were the stirring of the upper layer portion of molten magnesium alloy, the stirring of the inside of the molten magnesium alloy, and the rest method was no stirring. At this time, the stirring was performed at an upper layer portion of which a depth is about 10% of a total depth of the molten magnesium from the surface thereof. According to various stirring conditions, when comparing the case of the stirring of only the upper layer portion with the cases of no stirring and the stirring of the inside of the molten magnesium alloy, the smallest residual amount of the calcium oxide was confirmed in the case of the stirring of only the upper layer portion, that is, the final residual amounts of the calcium oxide were 0.001 wt %, 0.002 wt % and 0.005 wt % as the added amount of the calcium oxide was 5 wt %, 10 wt % and 15 wt %, respectively. That is, it can be understood that, when the upper layer portion of the molten magnesium alloy is stirred to allow CaO to react at the outer surface of the molten magnesium, most of CaO is decomposed into Ca. That is, Ca was added into the alloy by inducing the reduction reaction through further addition of CaO into the commercially available AM60B alloy.

TABLE 1

| | | Addition of 5 wt % of CaO | Addition of 10 wt % of CaO | Addition of 15 wt % of CaO |
|---|---|---|---|---|
| Alloy | No stirring | 4.5 wt % CaO | 8.7 wt % CaO | 13.5 wt % CaO |
| Residual amount of CaO | Stirring of inside of melt | 1.2 wt % CaO | 3.1 wt % CaO | 5.8 wt % CaO |
| | Stirring of upper layer portion of melt (present invention) | 0.001 wt % CaO | 0.002 wt % CaO | 0.005 wt % CaO |

The oxygen component of the alkaline earth metal oxide is substantially removed out from the top surface of the molten magnesium by stirring the upper layer portion of the molten magnesium. It is desirable that the stirring is performed at an upper layer portion of which a depth is about 20% of a total depth of the molten magnesium from the surface. If the depth is beyond 20%, the surface reaction according to a preferred example of the present invention is rarely generated. More preferably, the stirring may be performed in an upper layer portion of which a depth is about 10% of the total depth of the molten magnesium from the surface thereof. The substantially floating alkaline earth metal oxide is induced to be positioned in an upper layer portion of which a depth is 10% of an actual depth of the molten magnesium, thereby minimizing the turbulence of the molten magnesium.

In step S4 of exhausting the alkaline earth metal oxide, through the reaction between the molten magnesium and the added alkaline earth metal oxide, the alkaline earth metal oxide is completely exhausted so as not to remain in the magnesium alloy at least partially or substantially. It is preferable that all the alkaline earth metal oxide inputted in the present invention is exhausted by a sufficient reaction. However, even if some portions do not react and remain in the alloy, it is also effective if these do not largely affect physical properties.

Figure 3:
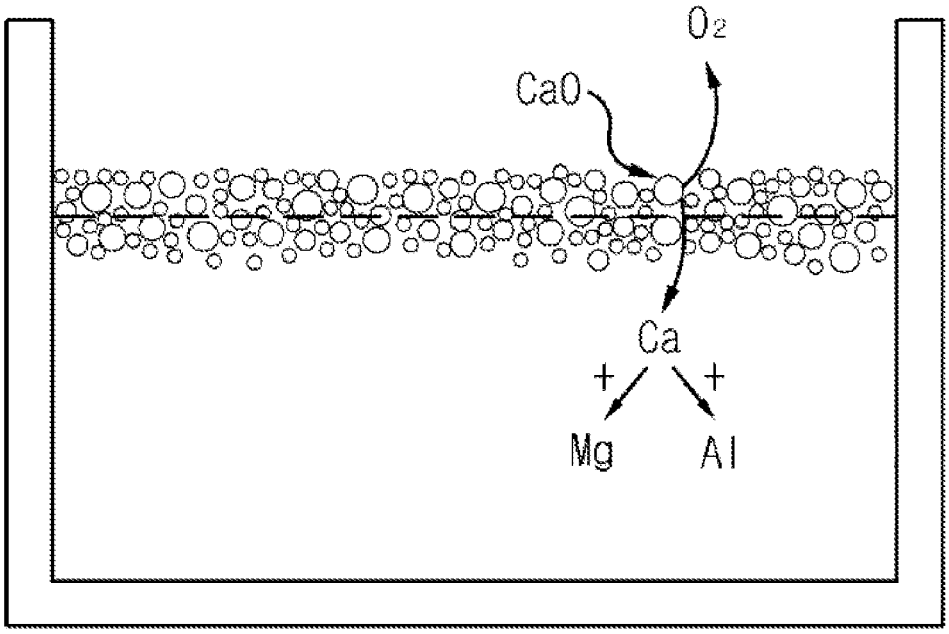
FIG. 3 is a schematic view exemplarily showing dissociation of an alkaline earth metal oxide through stirring of an upper layer portion of molten magnesium according to the present invention.

Herein, the exhausting of an alkaline earth metal oxide involves removing an oxygen component from the alkaline earth metal oxide. The oxygen component is removed in the form of oxygen gas ($O_2$) or in the form of dross or sludge through combination with magnesium or alloying components in the molten magnesium. The oxygen component is substantially removed out from the top surface of the molten magnesium by stirring the upper layer portion of the molten magnesium. FIG. 3 is a schematic view exemplarily showing dissociation of an alkaline earth metal oxide through stirring of an upper layer portion of molten magnesium according to the present invention.

In step S5, alkaline earth metal produced by the exhaustion of the alkaline earth metal oxide reacts with the molten magnesium alloy so as not to at least partially or substantially remain in the magnesium alloy. This means that the alkaline earth metal produced by the exhaustion is compounded with at least one of magnesium, aluminum, and other alloying elements (components) in the magnesium alloy, and is thus not left remaining substantially. Here, a compound refers to an intermetallic compound obtained through bonding between metals.

In the end, the added alkaline earth metal oxide is partially or substantially exhausted by removing the oxygen component through the reaction with the magnesium alloy, i.e., the molten magnesium alloy, and the produced alkaline earth metal makes a compound with at least one of magnesium in the magnesium alloy, aluminum, and other alloying elements in the molten magnesium alloy so that the alkaline earth metal does not partially or substantially remain in the magnesium alloy.

In step 5 of exhausting the alkaline earth metal oxide, there occur many flint flashes during the reduction reaction of the alkaline earth metal oxide on the surface of the molten magnesium. The flint flashes may be used as an index for confirming whether the reduction reaction is completed or not. In the case of terminating the reaction by tapping the molten magnesium while the flint flashes are being generated, the alkaline earth metal oxide added may not be fully exhausted. That is, the tapping of the molten magnesium is performed after the flint flashes, which can be used as an index for indirectly measuring the reduction reaction, disappear.

Figure 2:
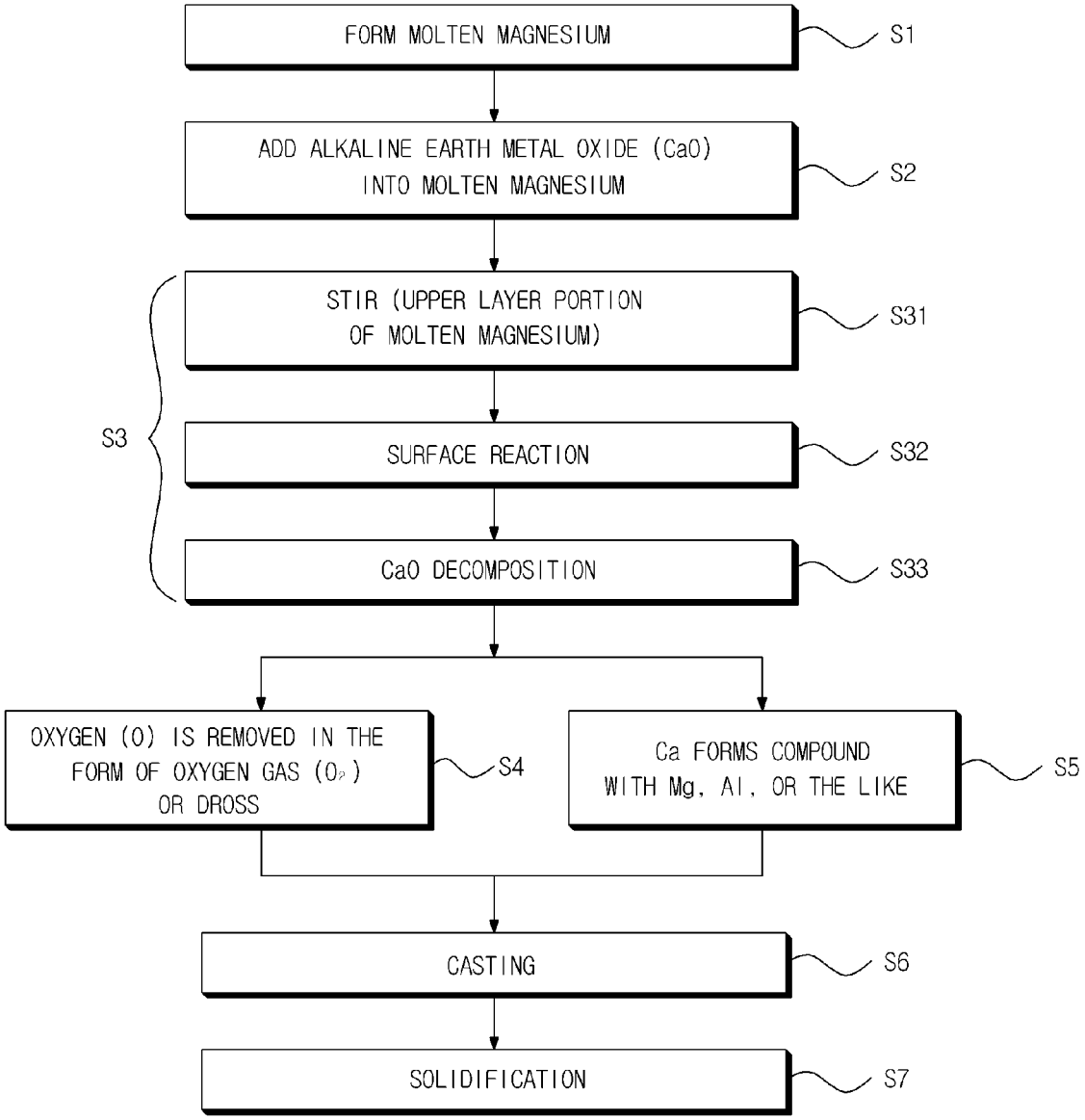
FIG. 2 is a flowchart illustrating dissociation of an alkaline earth metal oxide added into a magnesium alloy according to the present invention.

Processes described until now are illustrated in FIGS. 1 and 2. FIG. 2 is a flowchart illustrating dissociation of an alkaline earth metal oxide added into a magnesium alloy according to the present invention;

In the casting step S6, casting is performed by putting the molten magnesium into a mold at room temperature or in a pre-heating state. Herein, the mold may include any one selected from a metallic mold, a ceramic mold, a graphite mold, and equivalents thereof. Also, the casting method may include gravity casting, continuous casting, and equivalent methods thereof.

In the solidifying step S7, the mold is cooled down to room temperature, and thereafter, the magnesium alloy (e.g., magnesium alloy ingot) is taken out from the mold. The magnesium alloy manufactured by the above-described method may include at least one of Mg, Al, and other alloying elements of the molten magnesium, which will be described below.

The intermetallic compound mostly existed at grain boundaries between grains of the magnesium alloy, but partially existed inside the grains.

The magnesium-based alloy formed by the above-described manufacturing method may have hardness (HRF) of 40 to 80. However, the hardness value may change widely depending on processing methods and heat treatment or the like, and thus the magnesium-based alloy according to the present invention is not limited thereto.

In pure molten magnesium, magnesium in the molten magnesium reacts with alkaline earth metal to thereby form a magnesium (alkaline earth metal) compound. For example, if the alkaline earth metal oxide is CaO, $Mg_2Ca$ is formed. Oxygen constituting CaO is discharged out of the molten magnesium in the form of oxygen gas ($O_2$), or combines with Mg to be MgO and is then discharged in the form of dross (see Reaction Formula 1 below). (see Reaction Formula 1 below).

Pure Mg+CaO→Mg(Matrix)+$Mg_2Ca$ . . . [$O_2$ produced+MgO dross produced] —Reaction Formula 1

In a molten magnesium alloy, magnesium in the molten magnesium alloy reacts with alkaline earth metal to thereby form a magnesium (alkaline earth metal) compound or an aluminum (alkaline earth metal) compound. Also, an alloying element reacts with alkaline earth metal to form a compound together with magnesium or aluminum. For example, if the alkaline earth metal oxide is CaO, $Mg_2Ca$, $Al_2Ca$, or (Mg, Al, other alloying element)$_2$Ca is formed. Oxygen constituting CaO is discharged out of the molten magnesium in the form of oxygen gas ($O_2$) as in the pure Mg case, or combines with Mg to be MgO, which is discharged in the form of dross (see Reaction Formula 2 below).

Mg Alloy+CaO→Mg Alloy(Matrix)+($Mg_2Ca$+$Al_2Ca$+(Mg, Al, other alloying elements)$_2$Ca} . . . [$O_2$ produced+MgO dross produced] —Reaction Formula 2

As described above, the present invention makes it possible to manufacture a magnesium alloy economically when compared to conventional methods of manufacturing a magnesium alloy. An alkaline earth metal (e.g., Ca) is relatively a high-priced alloying element when compared to an alkaline earth metal oxide (e.g., CaO), and thus it acts as a main factor of increasing the price of magnesium alloys. Also, alloying is relatively easy by adding alkaline earth metal oxide into magnesium or the magnesium alloy instead of adding alkaline earth metal. On the other hand, alloying effects equal to or greater than the case of directly adding alkaline earth metal (e.g., Ca) can be achieved by adding the chemically stable alkaline earth metal oxide (e.g., CaO). That is, Ca, which is produced by the reduction reaction of the CaO added into the molten Mg, acts as an alloying element of Mg or Mg alloys.

Also, dissolution of the alkaline earth metal in the magnesium alloy occurs in a certain amount when the alkaline earth metal is directly input into magnesium or the magnesium alloy. On the other hand, in the case of applying technology of the present invention, dissolution is absent or extremely small during the addition of the alkaline earth metal oxide (CaO) when comparing degree of the dissolution with the case of directly adding the alkaline earth metal (Ca). It was confirmed that an intermetallic compound including an $Al_2Ca$ phase forms much easier when Ca is indirectly added through CaO as compared to the case of directly adding Ca. Therefore, in order to improve physical properties of the magnesium alloy, addition of more than a certain fraction of the alkaline earth metal is required. On the other hand, in the case of manufacturing the magnesium alloy by adding the alkaline earth metal oxide, it can be observed that the physical properties are more improved than the case of directly adding Ca due to the fact that a considerable amount of alkaline earth metal produced from the alkaline earth metal oxide forms intermetallic compounds with Mg or Al (e.g., $Mg_2Ca$ or $Al_2Ca$).

The magnesium-based alloy manufactured according to the present invention may be used as at least one selected from cast alloy, wrought alloy, creep alloy, damping alloy, degradable bio alloy, and powder metallurgy.

For example, the cast alloy may be formed by mixing an alkaline earth metal oxide (CaO) into AZ91D, AM20, AM50, or AM60. The wrought alloy may be formed by mixing CaO into AZ31 or AM30. The creep alloy may be formed by mixing CaO or SrO into Mg—Al or Mg—Al—Re, In addition, the creep alloy may be formed by mixing CaO into Mg—Al—Sn or Mg—Zn—Sn. The damping alloy may be formed by mixing CaO into pure Mg, Mg—Si, or SiCp/Mg. The degradable bio alloy may be formed by mixing CaO into pure Mg. The powder metallurgy may be formed by mixing CaO into Mg—Zn—(Y).

Figure 4:
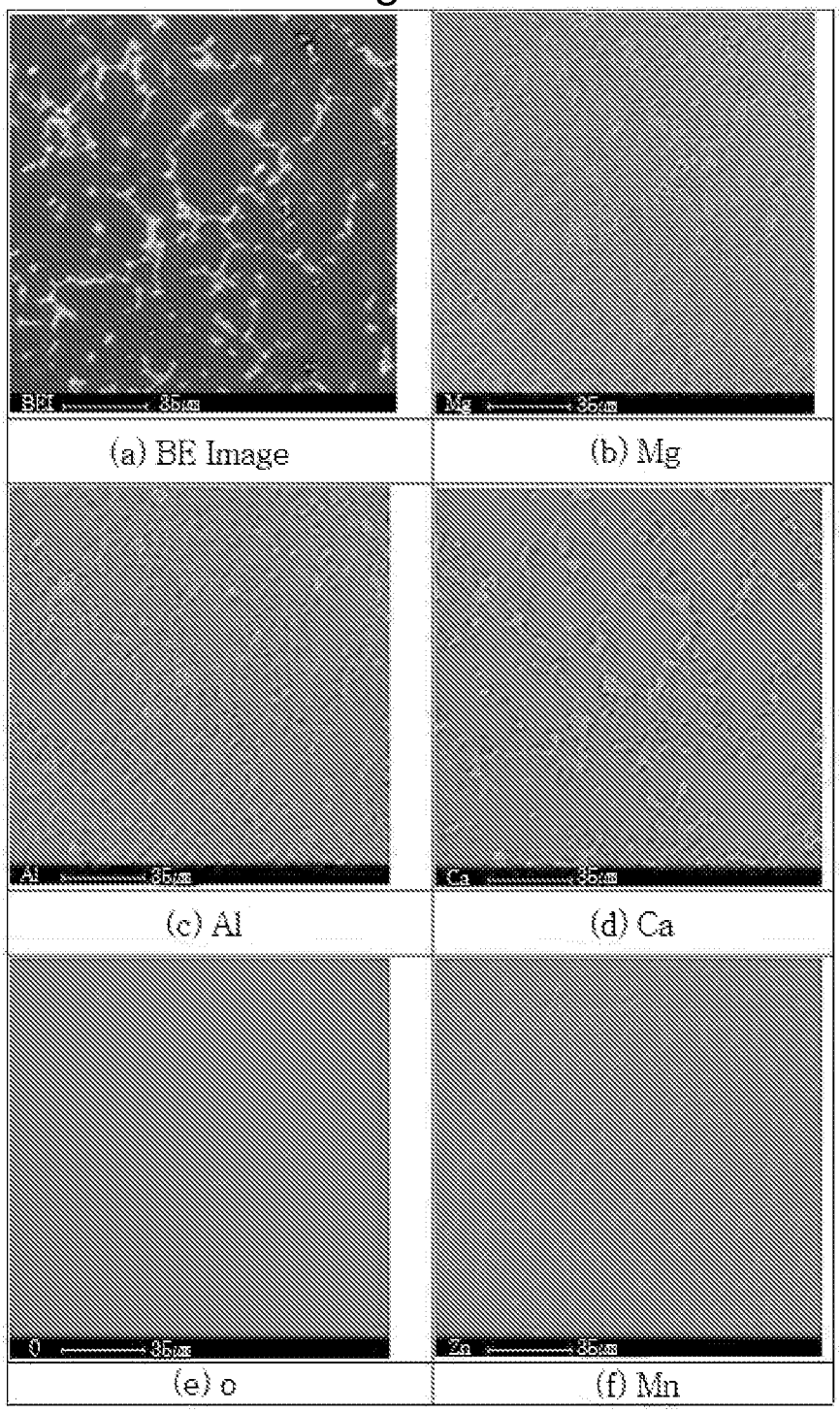
FIGS. 4(*a*) to 4(*f*) are EPMA (Electron Probe Micro Analyzer) images of magnesium alloys prepared by a manufacturing method of a magnesium alloy according to the present invention.
Figure 5A:
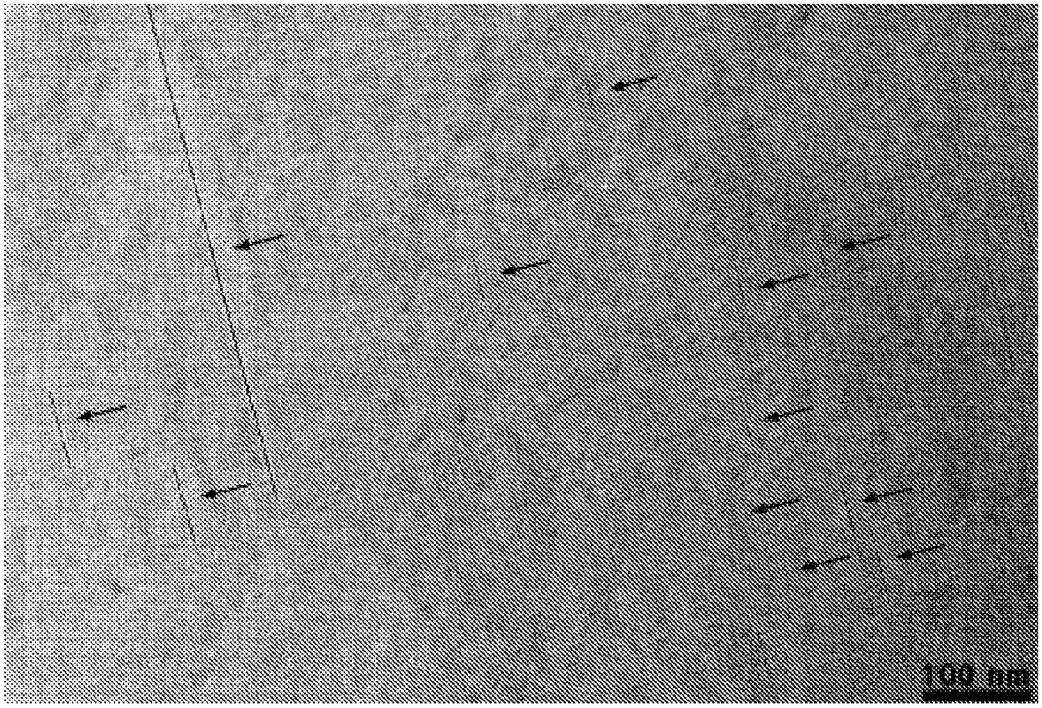
FIG. 5(*a*) is a TEM micrograph of a magnesium alloy manufactured according to the present invention.
Figure 5B:
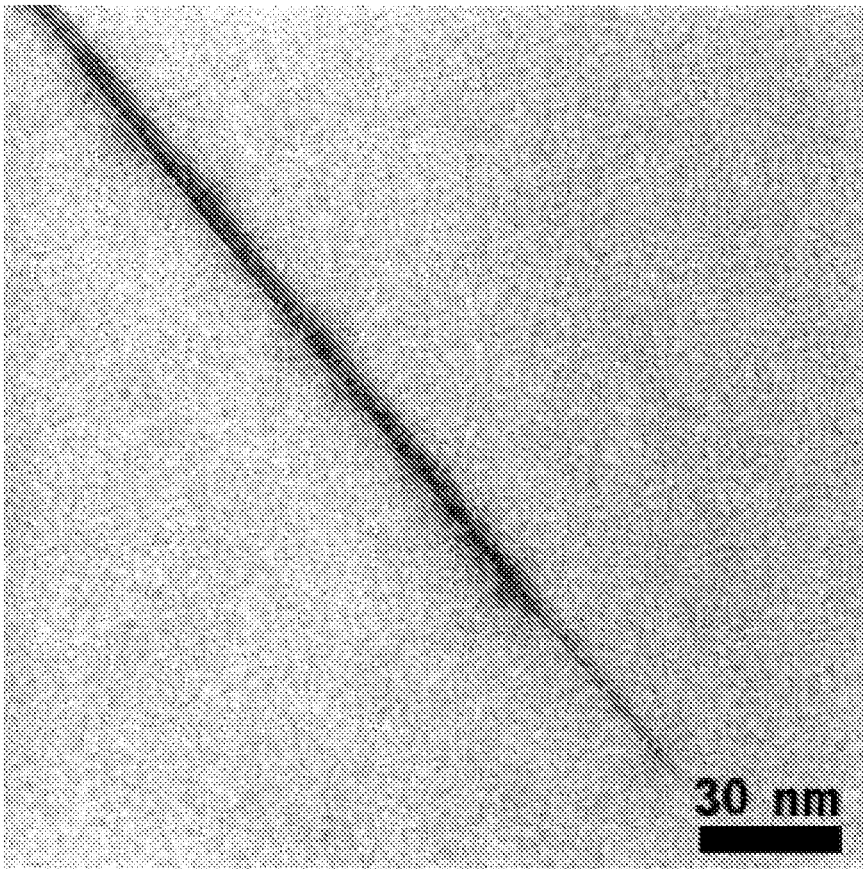
Figure 5C:
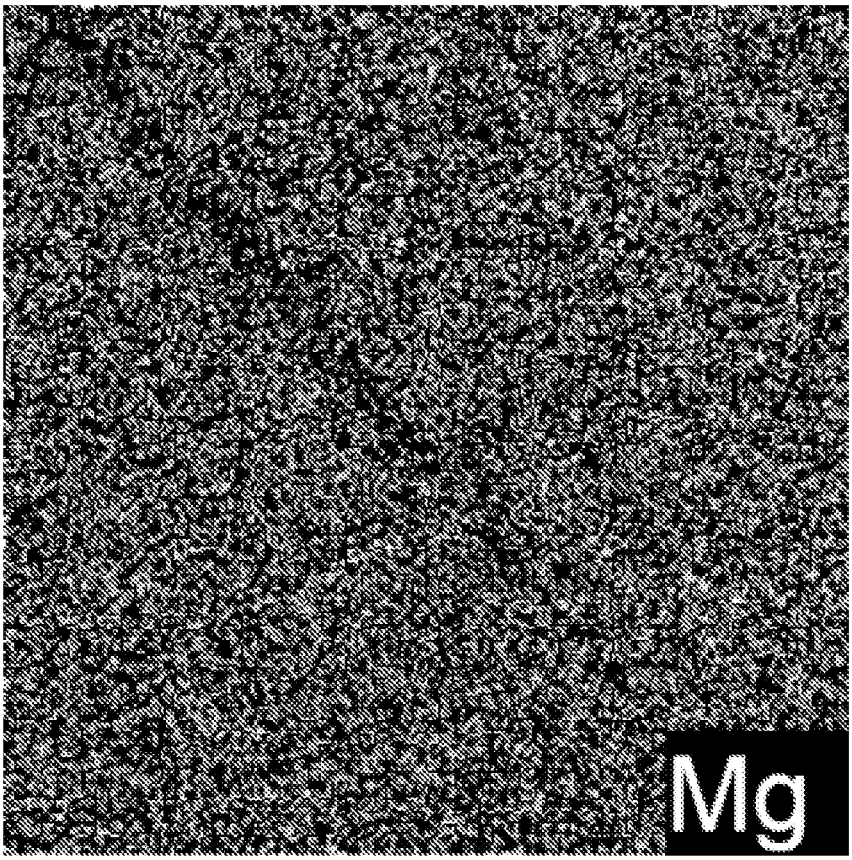
Figure 5D:
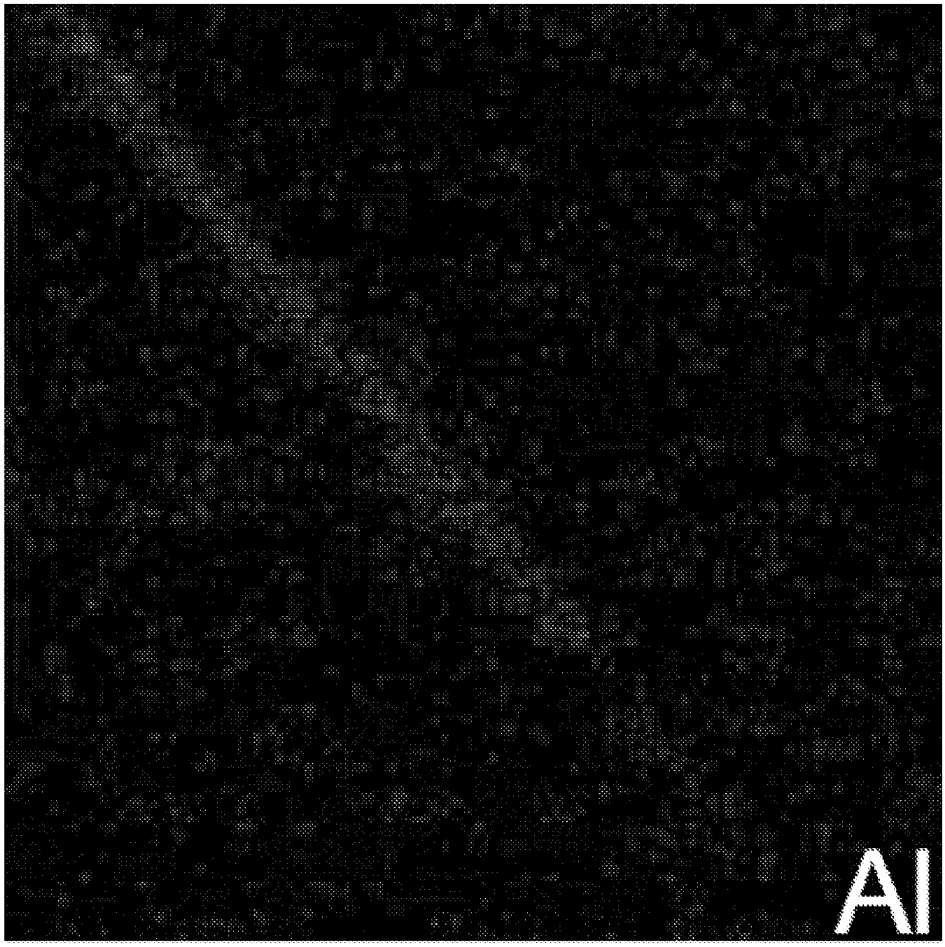
Figure 5E:
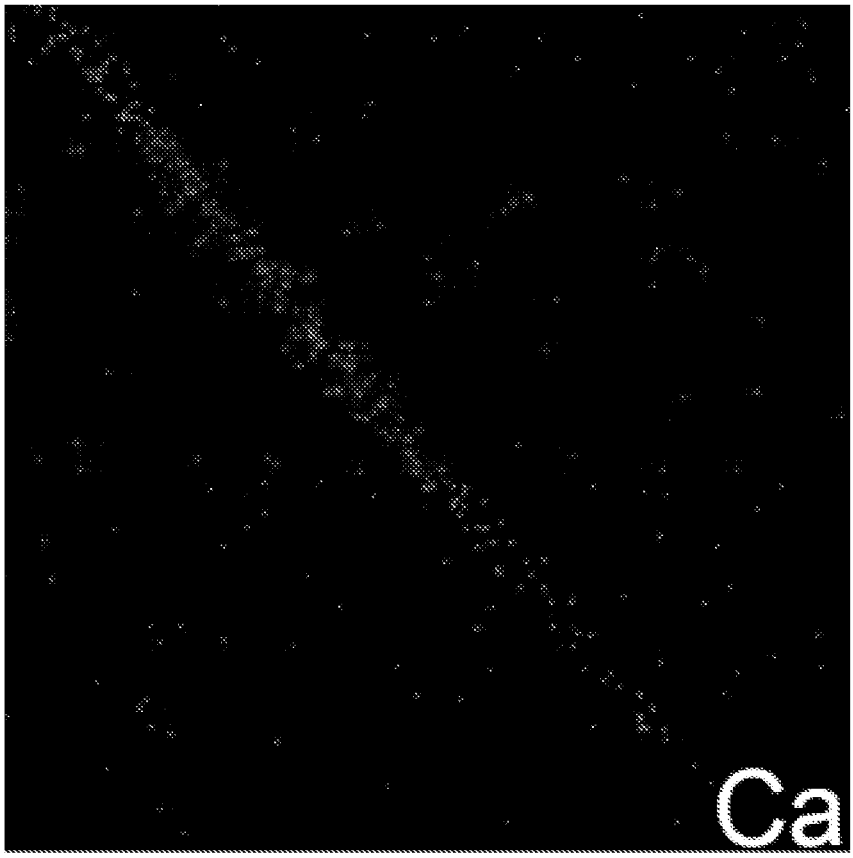

FIG. 4 is an EPMA (Electron Probe Micro Analyzer) mapping image showing components of Mg alloys prepared by the manufacturing method of the present invention by adding 0.45 wt % of CaO into a commercially available alloy, AM60B. FIG. 4(*a*) is a BE image of a Mg alloy from which it can be observed that the alloy is composed of grains and grain boundaries. FIG. 4(*b*) is an image of magnesium component in which a dark red region shows a Mg-rich region. A dark blue region shows a Mg-free region. FIG. 4(*c*) is an image of aluminum from which it can be observed that aluminum mainly exists at grain boundaries. It can be observed that the existing area of Ca in FIG. 4(*d*) overlaps the existing area of Al in FIG. 4(*c*). This is because Ca dissociated from CaO is not dissolved in a Mg matrix but forms an intermetallic phase with Al. FIG. 4(*f*) is an image of Mn from which it can be observed that the amount of Mn existing at grain boundaries is very smaller than the amount of Al. From FIG. 4(*e*), it can be confirmed that oxygen (O) rarely exists in the alloy. This demonstrates that oxygen (O) is separated from CaO added into the Mg alloy and removed out from the melt in the form of oxygen gas ($O_2$) or removed from the Mg alloy in the form of dross or sludge such as MgO. Herein, it can be confirmed that Ca supplied from CaO is prone to be compounded with elements other than Mg in the magnesium alloy.

That is, when CaO is added into the Mg alloy, CaO is dissociated into Ca and O. The separated Ca exists in the form of $Al_2Ca$ and other compounds in the Mg alloy.

As another example, EPMA mapping was performed on an alloy prepared by the manufacturing method of the present invention, by adding 0.52 wt % of CaO into an AZ91D alloy (image is not provided herein). From this example, it is also possible to obtain the same results as shown in FIG. 4. The intermetallic compound was mostly formed at grain boundaries, and small amount thereof existed in grains. The intermetallic compound formed in the grains and at the grain boundaries were observed in as-cast state prior to heat treatment.

FIG. 5(*a*) is a TEM (Transmission Electron Microscope) micrograph of a magnesium alloy manufactured by adding 0.24 wt % of CaO into an AM60 alloy. It can be observed that minute needle-shaped phases are formed in grains. FIG. 5(*b*) is an enlarged TEM micrograph of the minute needle-shaped phase in FIG. 5(*a*). FIGS. 5(*c*) to 5(*e*) are images obtained by mapping point EDS results on Mg, Al and Ca, respectively. Through distribution of Mg, Al and Ca elements, it could be confirmed that the needle-shaped phase was an Al—Ca compound. That is, it could be known that Ca elements overlap Al elements. This shows that Al and Ca form an intermetallic compound, and the intermetallic compound exists mostly at grain boundaries and also partially in grains.

Figure 6A:
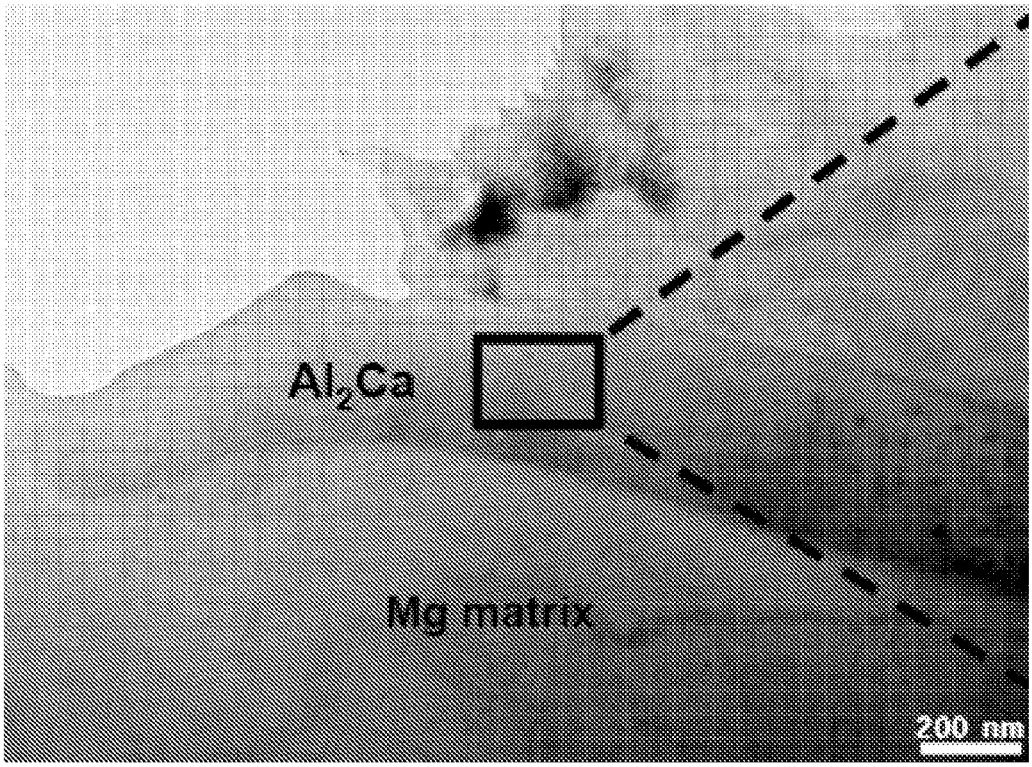
FIG. 6(*a*) is a TEM micrograph of a magnesium alloy manufactured according to the present invention, and FIG. 6(*b*) is a TEM diffraction pattern image of a rectangular area in FIG. 6(*a*)
Figure 6B:
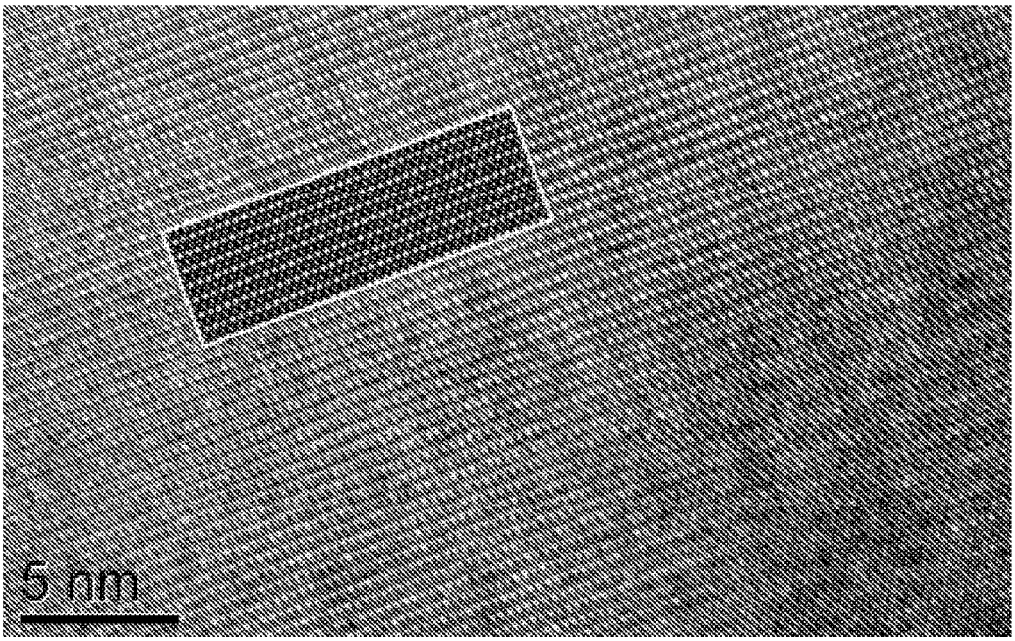

FIG. 6(*a*) is an image showing a secondary phase which is coarse and produced in the grains, besides the needle-shaped phase produced in the grains. It was observed that the coarse secondary phase exists in the shape of lamella inside the grains. FIG. 6(*b*) is an image showing a diffraction pattern of a rectangular area in FIG. 6(*a*) by TEM electron beam. The diffraction pattern image of FIG. 6(*b*) proved that an intermetallic compound is $Al_2Ca$.

In the case of various alloys manufactured according to the present invention, 90% or more of the intermetallic compound is formed at grain boundaries and less than 10% of the intermetallic compound is formed in grains. When 90% or more of the intermetallic compound exists at the grain boundaries, it is possible to obtain physical properties expected in the present invention. The volume ratio of the intermetallic compound was analyzed using EPMA images and TEM images. More preferably, 95% or more of the intermetallic compounds including $Al_2Ca$ are formed at grain boundaries and the others of less than 5% are formed in the grains.

A composition of the phase formed in the Mg alloy of the present invention was analyzed using point EDS. Table 2 shows point EDS results from which it can be understood that Al and Ca form a compound, i.e., $Al_2Ca$.

TABLE 2

| | wt % | at % |
|---|---|---|
| Al | 68.73 | 76.55 |
| Ca | 31.27 | 23.45 |
| Total | 100 | 100 |

Table 3 shows measurement results on other phases through point EDS. The measurement results of the phases formed are listed as phase 1 and phase 2. The measurement results of matrix are listed as matrix 1 and matrix 2. From Table 3 below, it can be confirmed that the addition of CaO into Mg or Mg alloy allows $Al_2Ca$ phase or other phases ($Mg_2Ca$, and (Mg, Al, other alloying elements)$_2$Ca) to be formed.

TABLE 3

| | | Matrix 1 | Phase 1 | Phase 2 | Matrix 2 |
|---|---|---|---|---|---|
| Mg | wt % | 98.5 | 68.5 | 80.2 | 99.1 |
| | at % | 98.6 | 63.5 | 83.6 | 99.2 |
| Al | wt % | 1.5 | 23.1 | 12.6 | 0.9 |
| | at % | 1.4 | 23.8 | 11.9 | 0.8 |
| Ca | wt % | 0 | 8.3 | 7.2 | 0 |
| | at % | 0 | 12.7 | 4.5 | 0 |

As described above, the addition of CaO into commercially available alloys enabled Ca to be indirectly alloyed. A magnesium alloy prepared by the addition of CaO had a relatively fine microstructure, and $Mg_2Ca$ and (Mg, Al, other alloying elements)$_2$Ca phases as well as $Al_2Ca$ phase were formed mostly at grain boundaries and also partially in grains. This results in an increase in both room-temperature strength and room-temperature ductility of the Mg alloy. Unlike typical magnesium alloys, the elongation of the magnesium alloy according to the present invention is increased at room temperature but decreased at high temperature. Also, high-temperature creep strain is decreased by suppressing deformation at high temperature, and therefore high-temperature creep resistance is increased.

Example 1

Figure 7:
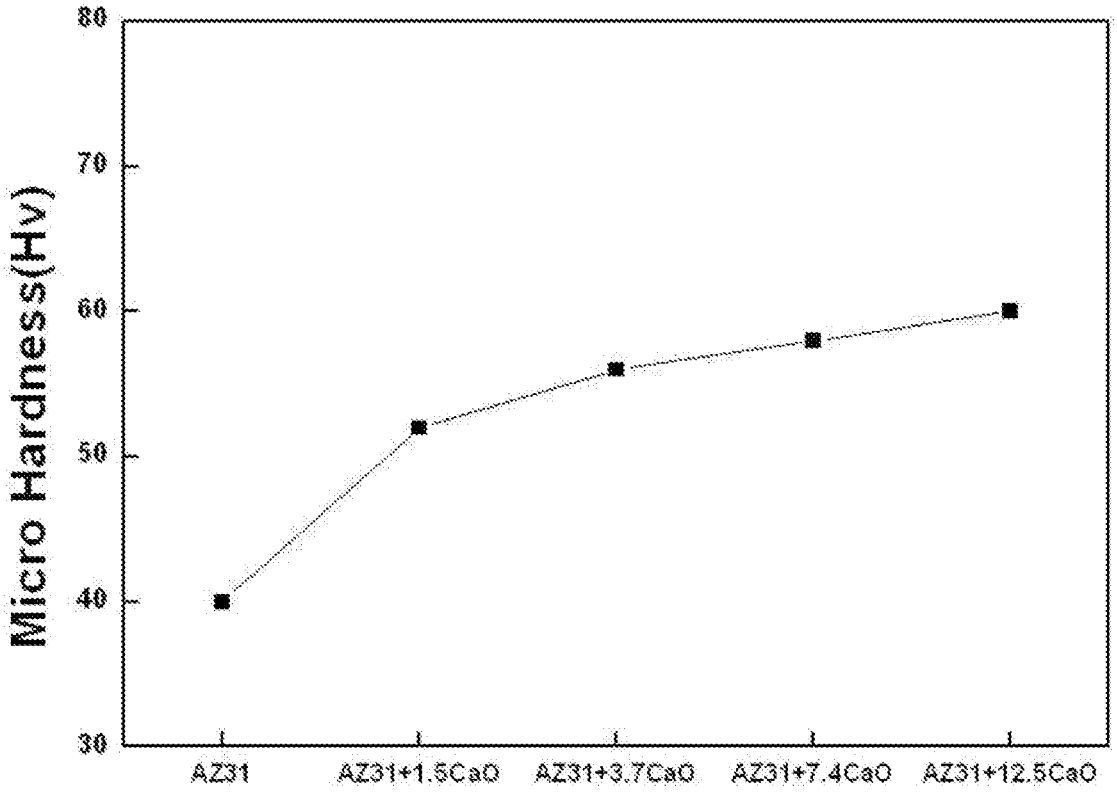
FIG. 7 is a graph showing room-temperature hardness of a magnesium alloy manufactured according to an embodiment of the present invention.

FIG. 7 is a graph showing room-temperature hardness of a magnesium alloy manufactured according to an embodiment of the present invention;

As shown in FIG. 7, it can be understood that the hardness of an AZ31 magnesium alloy with 1.5-12.5 wt % of CaO having a particle size of 100 μm added is increased as the added amount of CaO is increased. That is, the hardness of the AZ31 magnesium alloy into which CaO is not added is about at room temperature, whereas the hardness of the CaO-added AZ31 magnesium alloy is increased beyond 40.

The hardness versus the added amount (wt %) of CaO is shown in Table 4 below.

TABLE 4

| Alloy | Added amount of CaO | Hardness [Hv] |
|---|---|---|
| Magnesium lloy (AZ31) | 1.5 wt % | 52 |
| | 3.7 wt % | 55 |
| | 7.4 wt % | 58 |
| | 12.5 wt % | 60 |

Therefore, as shown in Table 4, it can be understood that the hardness is continually increased when 1.5-12.5 wt % of CaO is added into the Mg alloy. Also, if the added amount of CaO is 12.5 wt %, the hardness is about 60 which is higher than the hardness of the conventional AZ31 magnesium alloy by 50% or more.

Example 2

Figure 8:
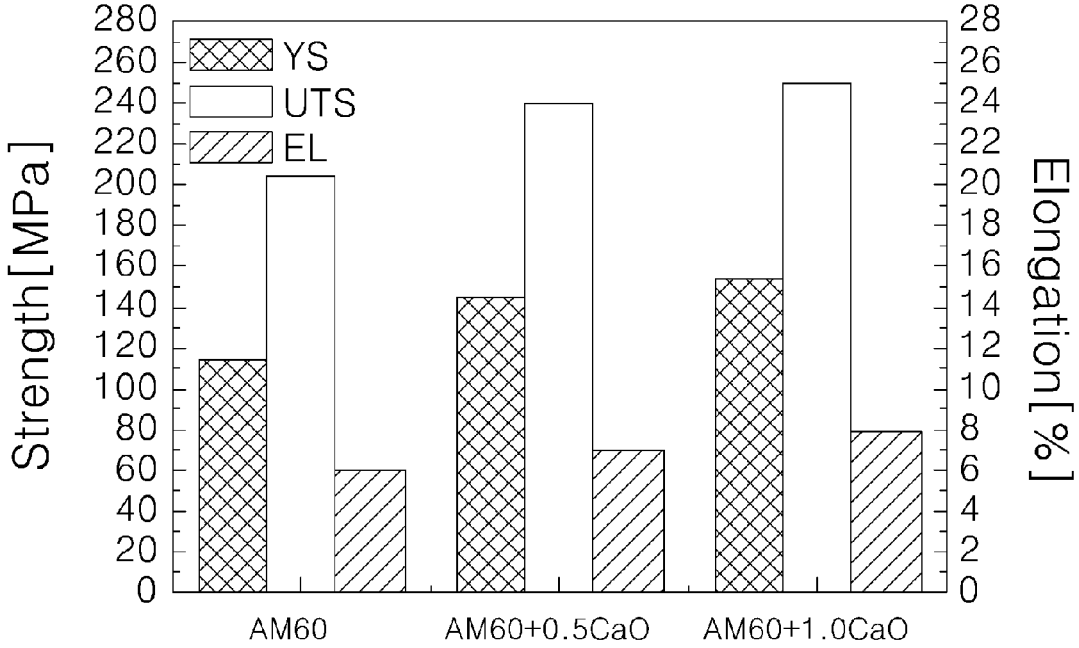
FIG. 8 is a graph showing mechanical properties of a magnesium alloy manufactured according to the present invention and mechanical properties of magnesium alloys manufactured by typical methods.

FIG. 8 is a graph comparing mechanical properties of a magnesium alloy manufactured according to the present invention with mechanical properties of typical magnesium alloys As illustrated in FIG. 8, a magnesium-based alloy (AM60+CaO) manufactured according to the present invention is superior in yield strength (YS), tensile strength (UTS) and elongation (EL) to typical AM60 alloys.

For example, the typical AM60 alloy has the yield strength of 115 [MPa], tensile strength of 215 [MPa], and elongation of 6%.

However, the magnesium alloy prepared by adding 1.0 wt % of CaO into an AM60 alloy has the yield strength of 152 [MPa], tensile strength of 250 [MPa], and elongation of 8%, and thus have remarkably superior mechanical properties to those of the typical AM60 alloy.

Example 3

Figure 9:
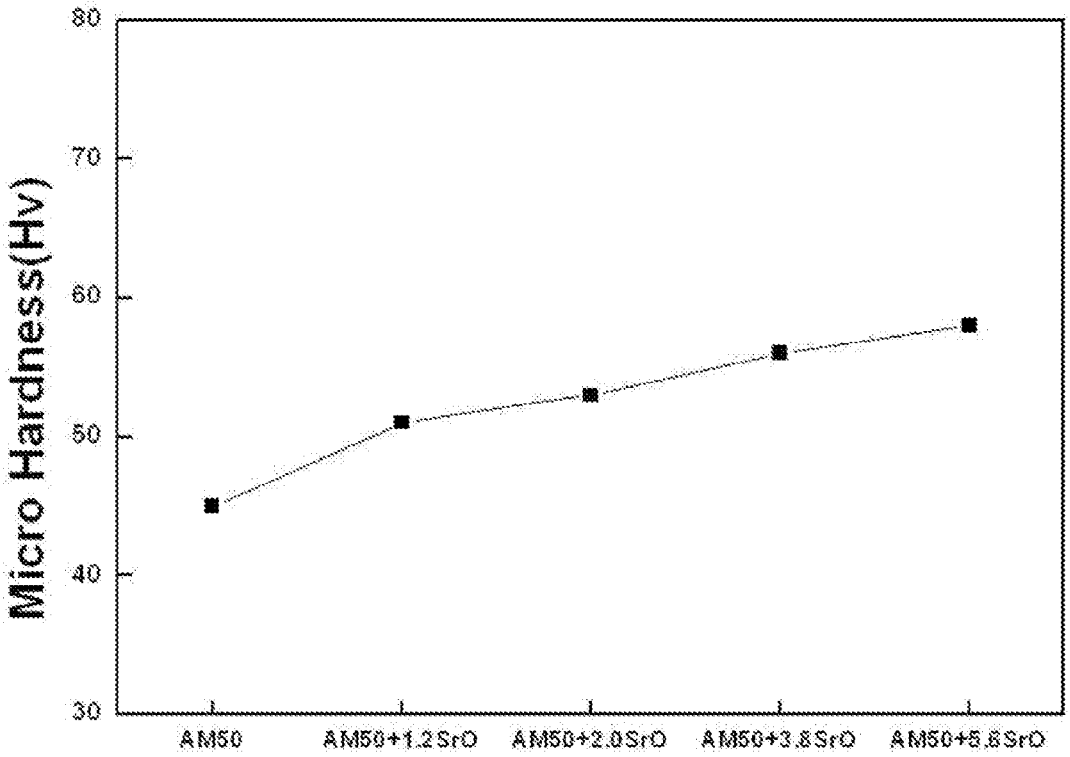
FIG. 9 is a graph showing room-temperature hardness of a magnesium alloy manufactured according to another embodiment of the present invention.

FIG. 9 is a graph showing room-temperature hardness of a magnesium alloy manufactured according to another embodiment of the present invention;

As shown in FIG. 9, it can be understood that the hardness of an AM50 magnesium alloy into which 1.2-5.6 wt % of SrO having the particle size of 150 μm is added during manufacturing process is increased as the added amount of SrO is increased. That is, the hardness of the AM50 magnesium alloy into which SrO is not added is about 45 at room temperature, whereas the hardness of the AM50 magnesium alloy into which small amount of SrO is added is about 50 or more.

The hardness according to the added amount (wt %) of SrO is shown in Table below.

TABLE 5

| Alloy | Added amount of SrO | Hardness [Hv] |
|---|---|---|
| Magnesium alloy (AM50) | 1.2 wt % | 51 |
| | 2.0 wt % | 53 |
| | 3.8 wt % | 55 |
| | 5.6 wt % | 57 |

Therefore, as shown in Table 5, it can be understood that the hardness is continually increased when 1.2-5.6 wt % of SrO is added into the Mg alloy. Also, if the added amount of SrO is 5.6 wt %, the hardness is about 57 which is higher than the hardness of the conventional AM50 magnesium alloy by 33% or more.

Example 4

Figure 10:
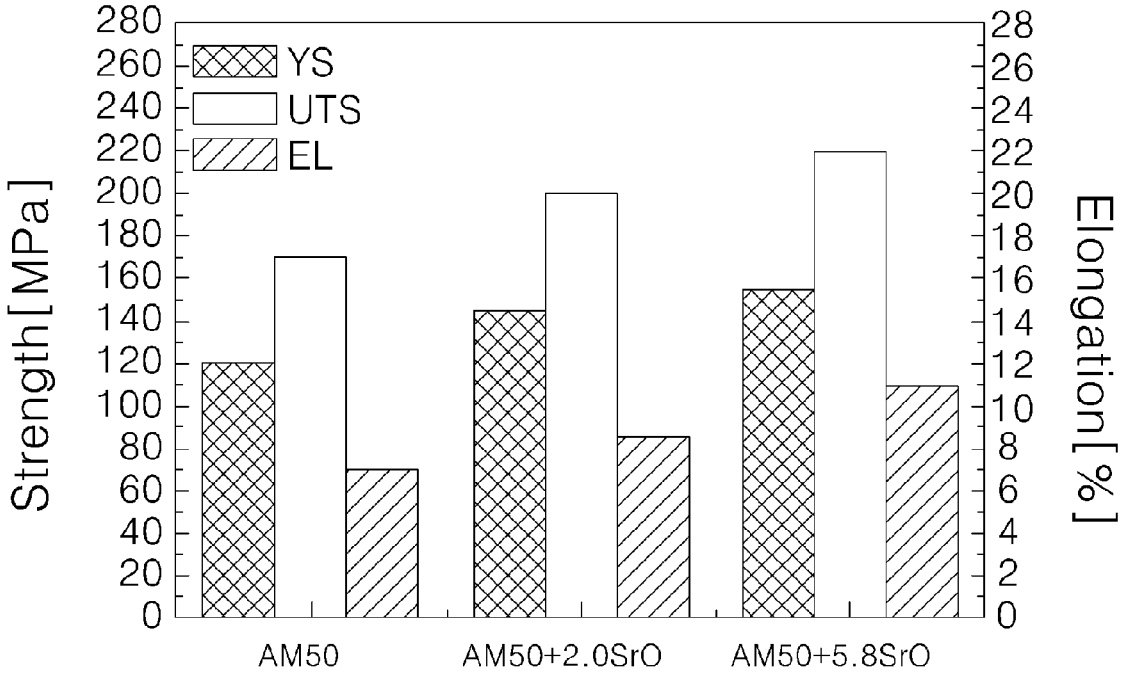
FIG. 10 is a graph showing mechanical properties of a magnesium alloy manufactured by a manufacturing method of a magnesium-based alloy according to the present invention and mechanical properties of magnesium alloys manufactured by typical methods.

FIG. 10 is a graph comparing mechanical properties of a magnesium alloy manufactured according to the present invention with mechanical properties of typical magnesium alloys (AM50).

As illustrated in FIG. 10, a magnesium-based alloy (AM50+SrO) manufactured according to the present invention is superior in yield strength (YS), tensile strength (UTS) and elongation (EL) to typical AM50 alloy.

For example, the typical AM50 alloy has the yield strength of 120 [MPa], tensile strength of 170 [MPa], and elongation of 7%.

However, the magnesium alloy prepared by adding 1.2 wt % of SrO into an AM50 alloy has the yield strength of 152 [MPa], tensile strength of 220 [MPa], and elongation of 11%, and thus mechanical properties are much more excellent than those of the typical AM50 alloy.

Example 5

Figure 11:
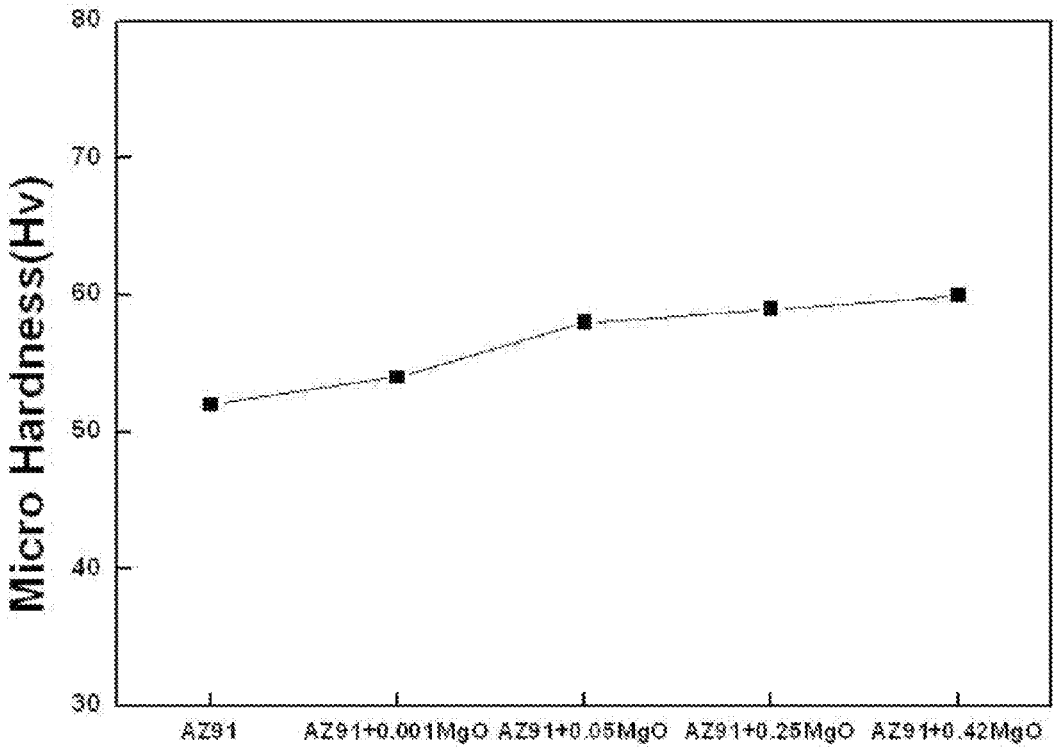
FIG. 11 is a graph showing room-temperature hardness of a magnesium alloy manufactured according to still another embodiment of the present invention.

FIG. 11 is a graph showing hardness test results of a magnesium alloy manufactured according to still another embodiment of the present invention.

As shown in FIG. 11, 0.001% to 0.42% by weight of MgO having a particle size of 150 μm was added into an AZ91 magnesium alloy. It can be understood that the hardness of the magnesium alloy with MgO added continues to be increased in comparison with the Mg alloys without addition of MgO.

That is, the hardness of the AZ91 magnesium alloy into which MgO is not added is about 51 at room temperature, whereas the hardness of the AZ91 magnesium alloy into which small amount of MgO is added is about 54 or more.

The hardness according to the added amount (wt %) of MgO is presented in Table 6 below.

TABLE 6

| Alloy | Added amount of MgO | Hardness [Hv] |
|---|---|---|
| Magnesium alloy (AZ91) | 0.001 wt % CaO | 53 |
| | 0.05 wt % | 58 |
| | 0.25 wt % | 59 |
| | 0.42 wt % | 60 |

Therefore, as shown in Table 6, it can be understood that the hardness is continually increased when 0.001-0.42 wt % of MgO is added into the Mg alloy. Also, if the added amount of MgO is 0.42 wt %, the hardness is about 60 which is higher than the hardness of the conventional AZ91 magnesium alloy by about 18% or more.

Example 6

After adding 5 wt %, 10 wt % and 15 wt % of calcium oxide having a particle size of 70 μm into a molten AM60B magnesium alloy, respectively, residual amounts of the calcium oxide in the magnesium alloy were measured according to stirring methods. The stirring methods used herein were the stirring of the upper layer portion of molten magnesium alloy, the stirring of the inside of the molten magnesium alloy, and the rest method was no stirring. As shown in Table 1, according to various stirring conditions, when comparing the case of the stirring of only the upper layer portion with the cases of no stirring and the stirring of the inside of the molten magnesium alloy, the smallest residual amount of the calcium oxide was confirmed in the case of the stirring of only the upper layer portion, that is, the final residual amounts of the calcium oxide were 0.001 wt %, 0.002 wt % and 0.005 wt % as the calcium oxide was added 5 wt %, 10 wt % and 15 wt %, respectively.

Example 7

Three pieces of AZ91D magnesium alloys each weighting 3 kg were prepared, and they were heated at 680° C. to thereby form a melt. Afterwards, 30 g (1 wt %) of CaO powders having particle size of less than 100 μm, 100-200 μm, and 500 μm, respectively, were input into each melt. Thereafter, each molten magnesium alloy was stirred for 10 minutes at the surface thereof. Next, the respective molten magnesium alloys were poured into molds and then cast through gravity casting. Finally, the molten magnesium alloys were cooled, and components thereof were analyzed through inductively coupled plasma (ICP).

Particle size, input amount, component analysis by ICP and yield are listed in Table 7 below.

TABLE 7

| | Particle size | | |
|---|---|---|---|
| | ~100 μm | ~200 μm | ~500 μm |
| Input amount | 3.1 wt % CaO | 3.1 wt % CaO | 3.1 wt % CaO |
| Component analysis by ICP | 0.45 wt % Ca | 0.005 wt % CaO | 0.002 wt % CaO |
| Yield | 45% | 0.78% | 0.42% |

When the particle size of CaO is less than 100 μm, it is possible to obtain yield of 45% substantially. That is, when 1 wt % of CaO is added, 0.45 wt % of Ca was dissolved in the molten magnesium. However, when the particle size of CaO is 200 μm or 500 μm, the yield is considerably reduced to 0.78 wt % and 0.42 wt %, respectively.

Example 8

The room-temperature hardness of a magnesium alloy manufactured according to the present invention was measured. It can be understood that the hardness of an AZ91D magnesium alloy with 1-12 wt % of CaO having the particle size of 100 μm added is increased as the added amount of CaO is increased. That is, the hardness of the AZ91D magnesium alloy into which CaO is not added is about 57 at room temperature, whereas the hardness of the CaO-added AZ91D magnesium alloy is increased beyond 57.

Example 9

The hardness of a magnesium alloy manufactured according to the present invention was measured. 3-12 wt % of MgO having the particle size of 150 μm was added into an AM50 magnesium alloy. It can be understood that the hardness of the magnesium alloy with MgO added continues to be increased compared to the Mg alloys with no MgO added.

In the present invention, the amount of CaO input into the molten magnesium or magnesium alloy may be 1.4 times the weight of a final Ca target composition under the assumption that all CaO are reduced into Ca. Herein, for alloying the target amount of Ca using the CaO, the added amount of CaO in the molten magnesium alloy is 1.4 times to 1.7 times the weight of the final Ca target composition. By considering the amount that may not react with the molten magnesium alloy and mix with dross on the surface of the molten magnesium alloy, the amount of CaO may be added 1.4 times to 1.7 times the weight of the final Ca target composition.

Figure 12:
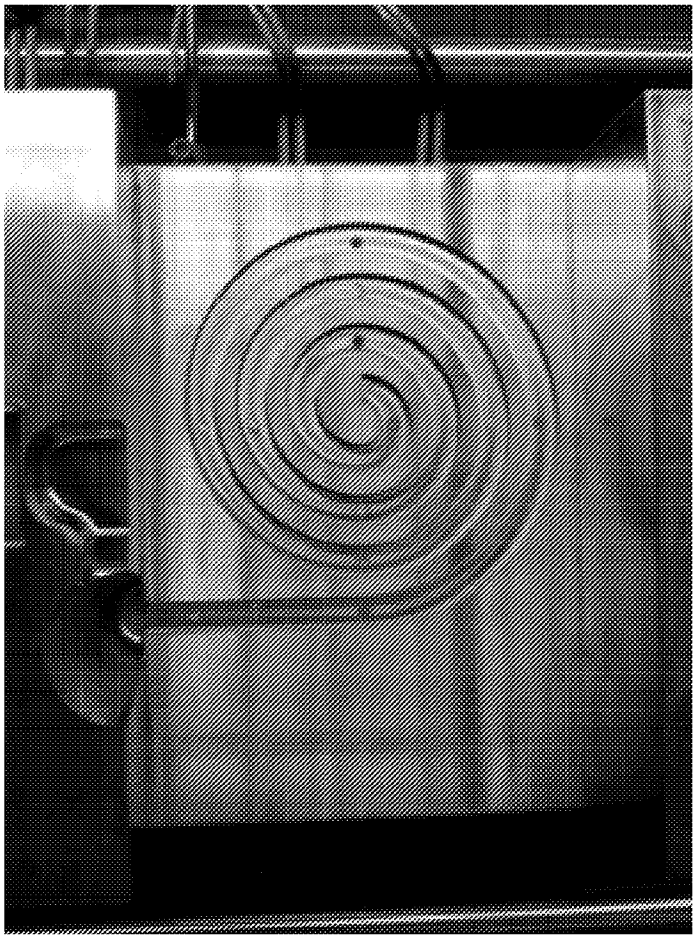
FIG. 12 is an image showing a spiral mold prepared for evaluating melt fluidity.

FIG. 12 is an image showing a spiral mold prepared for evaluating melt fluidity; A spiral mold was prepared to analyze the fluidity of a molten magnesium or magnesium alloy into which an alkaline earth metal oxide was added.

The fluidity of AZ31 alloy (AZ31-CaO) prepared by adding CaO was compared with the fluidity of AZ31 alloy (AZ31-Ca) by adding Ca. The two alloys (AZ31-CaO and AZ31-Ca) were poured into the spiral mold under the same conditions by gravity casting, and how long the alloys in liquid state flows into the spiral mold were measured until the liquid alloys are solidified.

Figure 13:
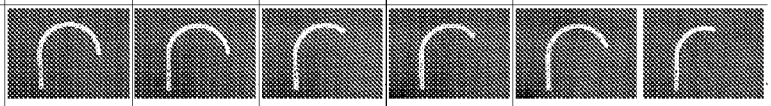
FIG. 13 is an image showing fluidity of a Mg alloy by varying the content of Ca added into an AZ31 magnesium alloy.
Figure 13:
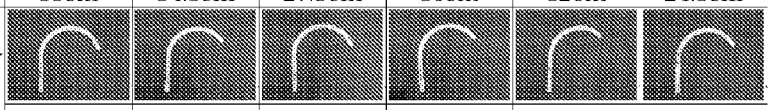

FIG. 13 is an image showing fluidity of a Mg alloy by varying the amount of Ca added into an AZ31 magnesium alloy; Alkaline earth metal, Ca, was directly added into the magnesium alloy.

Figure 14:
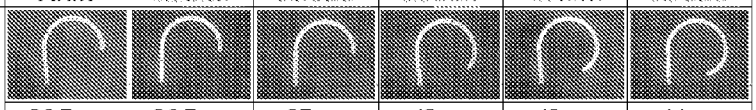
FIG. 14 is an image showing fluidity of a Mg alloy by varying the content of Ca added into an AZ31 magnesium alloy.
Figure 14:
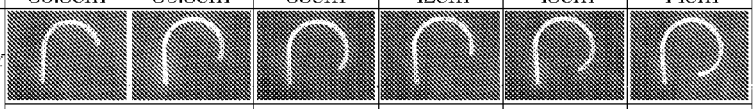

FIG. 14 is an image showing fluidity of a Mg alloy by varying the amount of Ca added into an AZ31 magnesium alloy; CaO of alkaline earth metal oxide was indirectly added into the magnesium alloy, and thereafter Ca of alkaline earth metal was added by triggering surface reduction reaction.

For experiments in FIGS. 13 and 14, alloys were melted in an electric furnace, and then heated up to 690 V. At this temperature, dross was removed, and primary casting was performed. After the primary casting, the decreased temperature is raised again up to 690 r, and then secondary casting was performed. A temperature of a mold during casting was maintained at 280° C.

As the added amount of Ca was increased, fluidity was decreased overall. However, in contrast with the case of Ca added, as the added amount of CaO was increased, fluidity is also increased. Resultingly, AZ31 alloy prepared by adding the same weight percentage of CaO as the amount of Ca was significantly superior in fluidity to the alloy prepared by directly adding Ca. That is, when 0.9 wt % of CaO was added into AZ31, the cast length was 44.75 cm on the average; however, when the same amount of Ca was added into AZ31, the cast length was 27 cm on the average.

Figure 15:
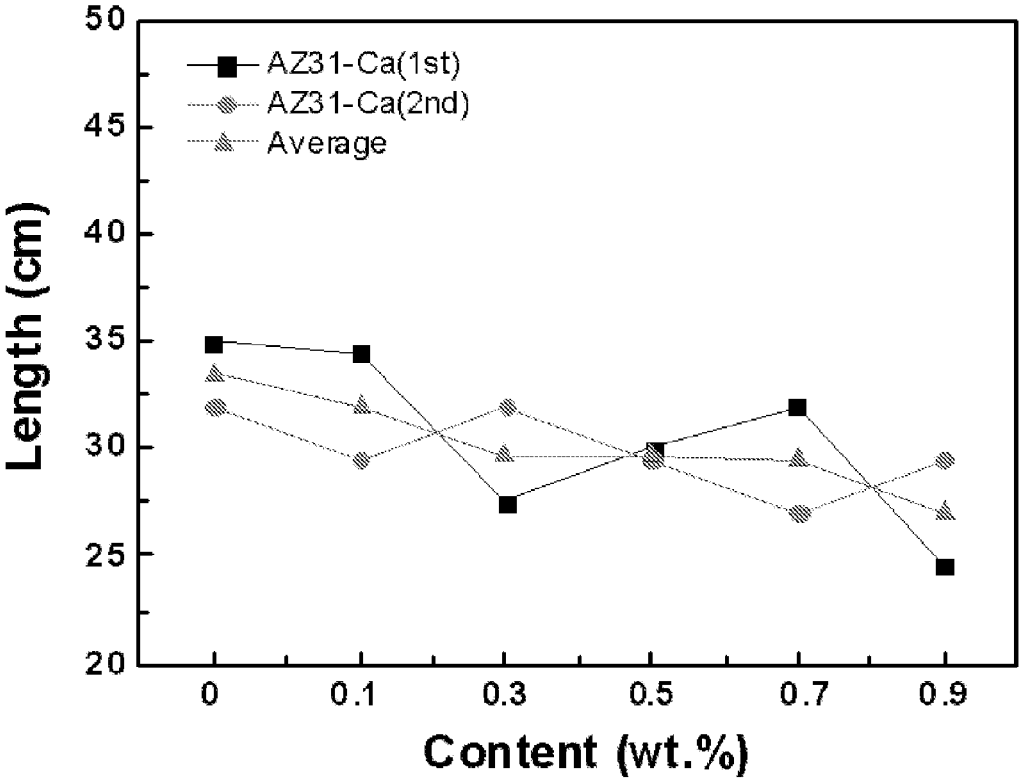
FIG. 15 is a graph showing fluidity of a Mg alloy by varying the content of Ca added into an AZ31 magnesium alloy.

FIG. 15 is a graph showing the fluidity of a Mg alloy prepared by adding Ca into AZ31. Overall, the fluidity was decreased as the amount of Ca was increased.

Figure 16:
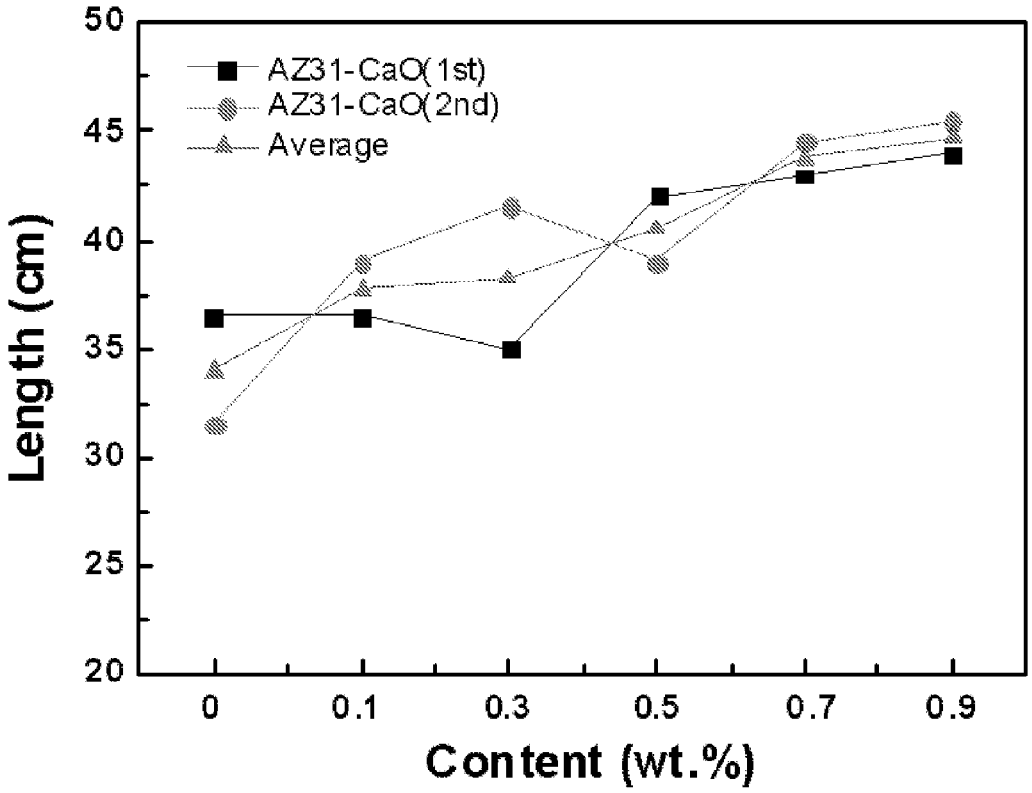
FIG. 16 is a graph showing fluidity of a Mg alloy where the same amount of Ca as that of FIG. 7 is alloyed through reduction reaction by adding CaO into AZ31.

FIG. 16 is a graph showing the fluidity of a Mg alloy prepared by indirectly adding the same amount Ca as that of Ca in FIG. 15 through reduction reaction, that is, by adding CaO into AZ31. Compared to the Mg alloy without the addition of CaO, the fluidity of the Mg alloy with 0.9 wt % of CaO added was increased by about 30%. It can be observed that the fluidity is increased as the amount of CaO is increased overall. The fluidity of the magnesium alloy in which the same amount of Ca is indirectly added by adding CaO was about 1.5 times greater than the fluidity of the magnesium alloy in which Ca is directly added.

Figure 17:
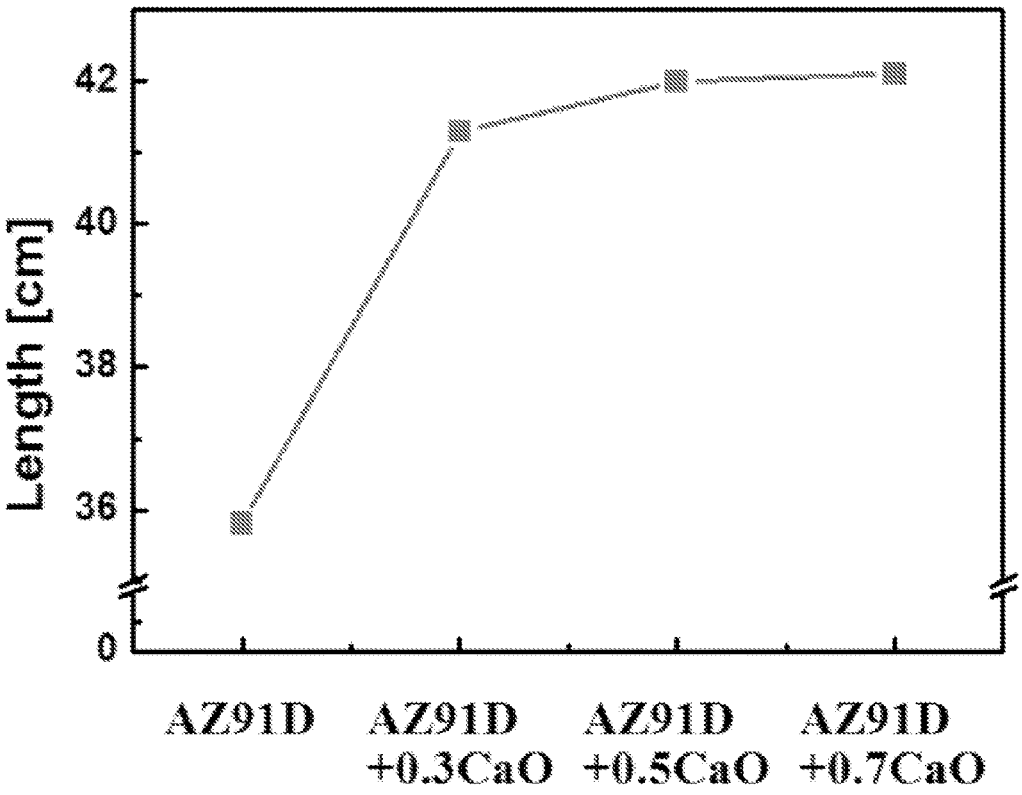
FIG. 17 is a graph showing the length of a cast product which is produced in a spiral mold while increasing the amount of CaO added into an AZ91D magnesium alloy.

FIG. 17 is a graph showing the length of a cast product which is produced in a spiral mold while increasing the amount of CaO added into an AZ91D magnesium alloy. It was confirmed that castability was increased as the amount of CaO was increased. Like AZ31 alloy, the fluidity of molten AZ91D alloy was also increased as the added amount of CaO was increased. Herein, it was also confirmed that the fluidity was remarkably increased as the added amount of CaO was 0.3 wt % or more.

Crack degrees and crack locations of cast products were measured to evaluate hot-tearing resistance of Mg alloys. To this end, a melt was prepared through gravity casting in a mold including four rod-shaped parts having different length from one another, as illustrated in FIG. 18.

Figure 18:
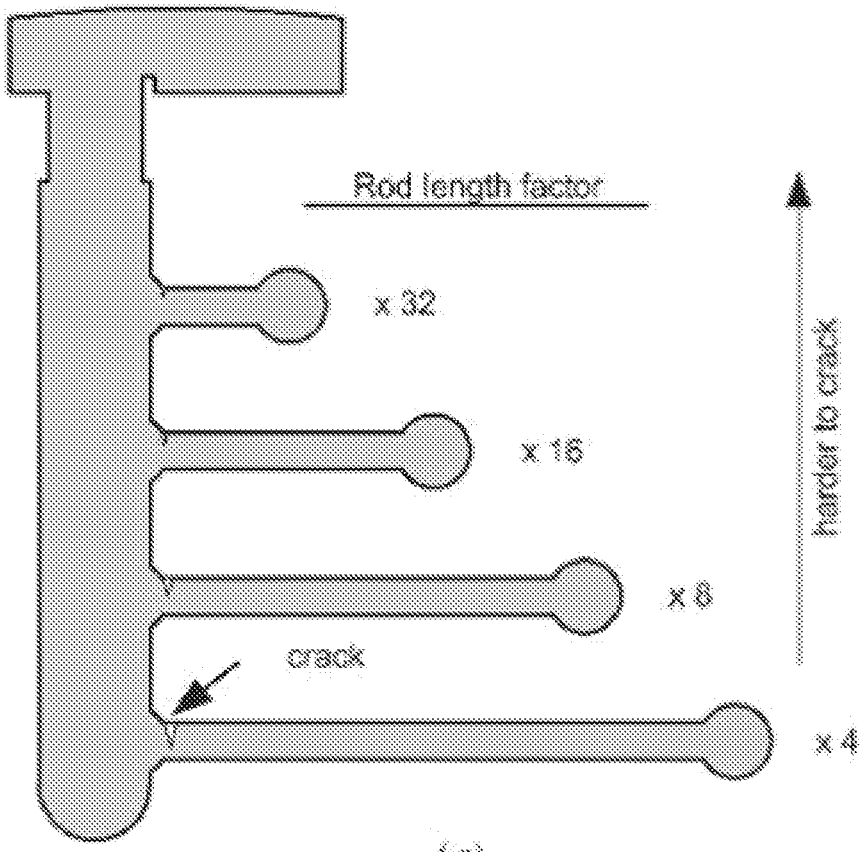
FIGS. 18 and 19 are schematic views illustrating evaluation factors of hot-tearing susceptibility (HTS)
Figure 19:
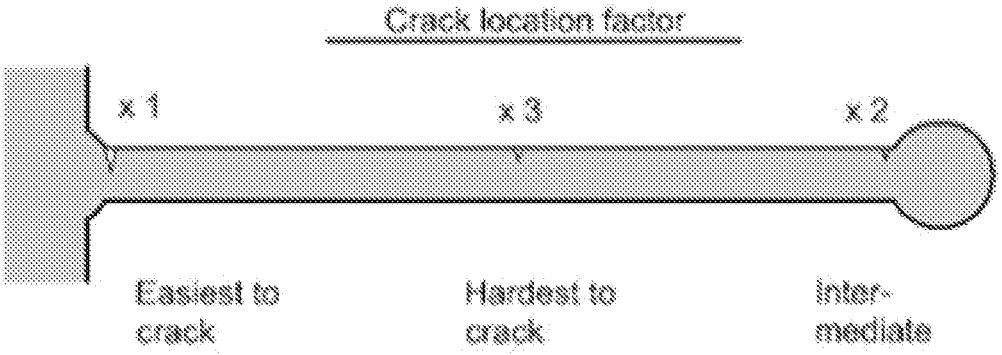

FIGS. 18 and 19 are schematic views illustrating evaluation factors of hot-tearing susceptibility (HTS). Crack size (unit: mm), length, location were set as factors for evaluating hot-tearing susceptibility. Different weights were given to values depending on crack degrees and crack locations in cast products, and then hot-tearing susceptibility (HTS) was evaluated by numerically summing the weighted values. Here, the crack size factor is a length (mm) of crack produced in cast products.

As illustrated in FIG. 18, the length factor was defined as 'rod length factor' depending on the length of a rod branched from a cast main body. For example, the weight of 32 was given to the shortest rod in FIG. 18. The weight was reduced by half if the length was increased twice. As a result, weight of 4 was given to the longest rod. That is, the weight of 32 was given to the shortest rod, which means the rod has the lowest possibility of being cracked.

The location factor was defined by varying weights according to crack locations in each rod. As illustrated in FIG. 19, the weight was 1 if there was a crack in a connection part (neck part) between the cast main body and the rod; the weight was 3 if there was a crack in a middle portion of the rod; and the weight was 2 if there was a crack at the end of the rod. That is, crack is more easily generated as the weight becomes higher. The crack is rarely generated at the middle portion of the rod, and easily generated at the neck part.

Hot-tearing susceptibility (HTS) was defined as Equation below.

$$\text{HTS(Hot Tearing Susceptibility)}=\Sigma(W_{crack}\times f_{length}\times f_{location})$$

$W_{crack}$: Size factor of crack $f_{length}$: Length factor $f_{location}$: Location factor The sum of HTS values for respective cracks generated in a single cast product represents susceptibility of the cast product. If the HTS value is high, the case product is susceptible to hot-tear crack, which means poor hot-tearing resistance.

Figure 20:
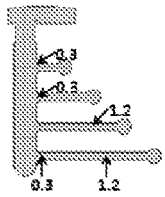
FIG. 20 is a table showing evaluation results on hot-tearing susceptibilities of an AZ31 alloy and Mg alloys prepared by adding 0.1 wt %, 0.3 wt %, 0.5 wt %, 0.7 wt % and 0.9 wt % of Ca into an AZ31 alloy.
Figure 20:
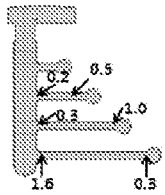
Figure 20:
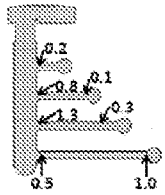
Figure 20:
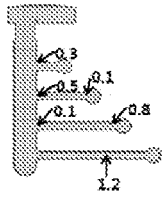
Figure 20:
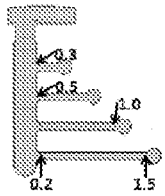
Figure 20:
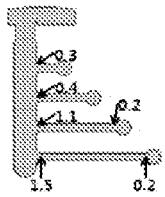

FIG. 20 is a table showing evaluation results of hot-tearing susceptibilities of an AZ31 alloy and alloys prepared by adding 0.1 wt %, 0.3 wt %, 0.5 wt %, 0.7 wt % and 0.9 wt % of Ca into an AZ31 alloy; The HTS of AZ31 alloy into which Ca is not added is very poor, and the HTS becomes better as the amount of Ca increases.

Figure 21:
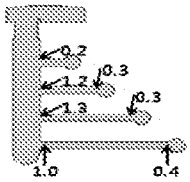
FIG. 21 is a table showing evaluation results of hot-tearing susceptibilities of an AZ31 alloy and Mg alloys prepared by adding 0.1 wt %, 0.3 wt %, 0.5 wt %, 0.7 wt % and 0.9 wt % of CaO into an AZ31 alloy.
Figure 21:
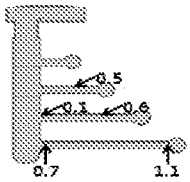
Figure 21:
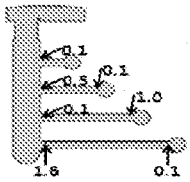
Figure 21:
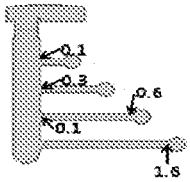
Figure 21:
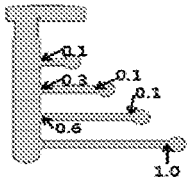
Figure 21:
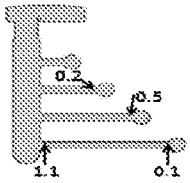

FIG. 21 is a table showing evaluation results of hot-tearing susceptibilities of an AZ31 alloy and alloys prepared by adding 0.1 wt %, 0.3 wt %, 0.5 wt %, 0.7 wt % and 0.9 wt % of CaO into an AZ31 alloy; The HTS of AZ31 alloy into which CaO is not added is very poor, and the HTS becomes better as the amount of CaO increases. The Mg alloy prepared by adding CaO is significantly superior in HTS to the Mg alloy prepared by directly adding Ca into AZ31 alloy. That is, the HTS value is very low in the case of the Mg alloy with CaO added.

Figure 22:
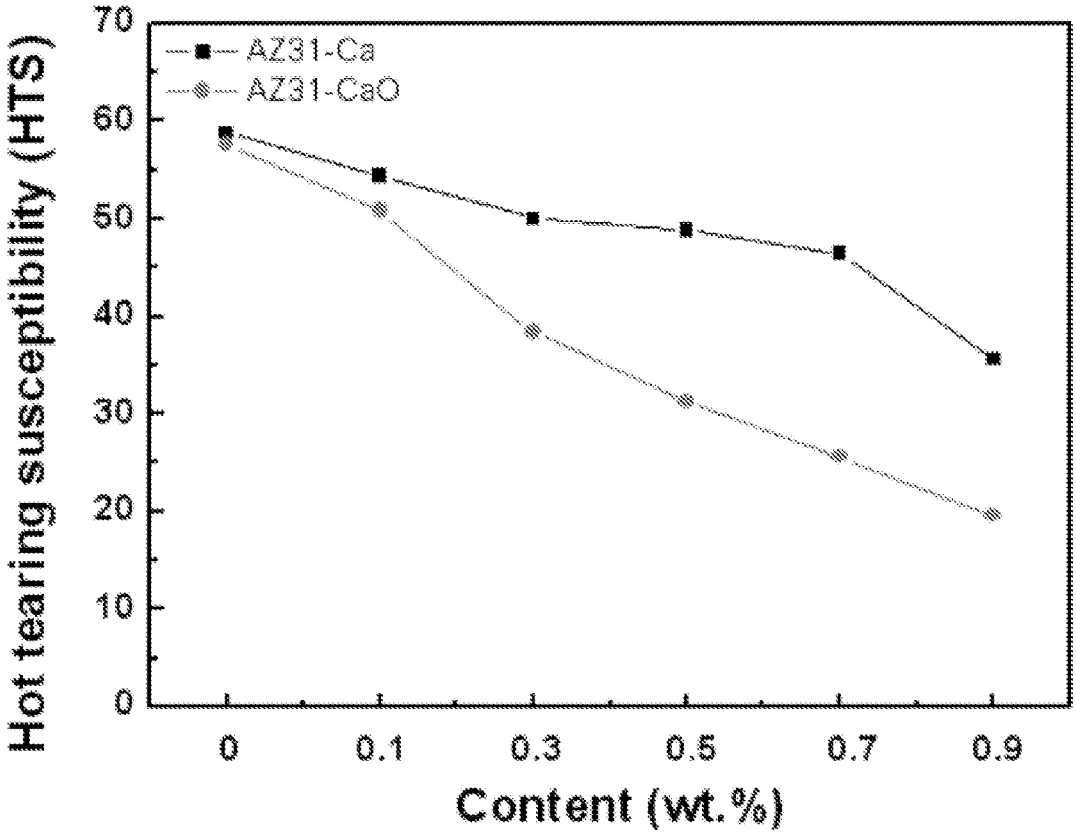
FIG. 22 is a graph comparing an HTS value of a Mg alloy (AZ31-Ca) prepared by directly adding Ca into AZ31 with an HTS value of a Mg alloy (AZ31-CaO: Eco-AZ31) where the same amount of Ca is alloyed by adding CaO into AZ31.

FIG. 22 is a graph comparing an HTS value of a Mg alloy (AZ31-Ca) prepared by directly adding Ca into AZ31, with an HTS value of a Mg alloy (AZ31-CaO: Eco-AZ31) where Ca is indirectly added through reduction reaction by adding CaO into AZ31. AZ31-Ca alloys were prepared by adding 0.1 wt %, 0.3 wt %, 0.5 wt %, 0.7 wt %, and 0.9 wt % of Ca, and Eco-AZ31 alloys having the same compositions as the AZ31-

Ca alloys were prepared by adding CaO. HTS values in both of the Mg alloys were decreased as the amount of Ca or CaO was increased. However, the decrease in HTS value is more significant in the Mg alloy with CaO added rather than the Mg alloy with Ca added. It can be confirmed that the HTS of the Mg alloy with CaO added is improved by about 50% compared to that of the Mg alloy with Ca added.

Figure 23:
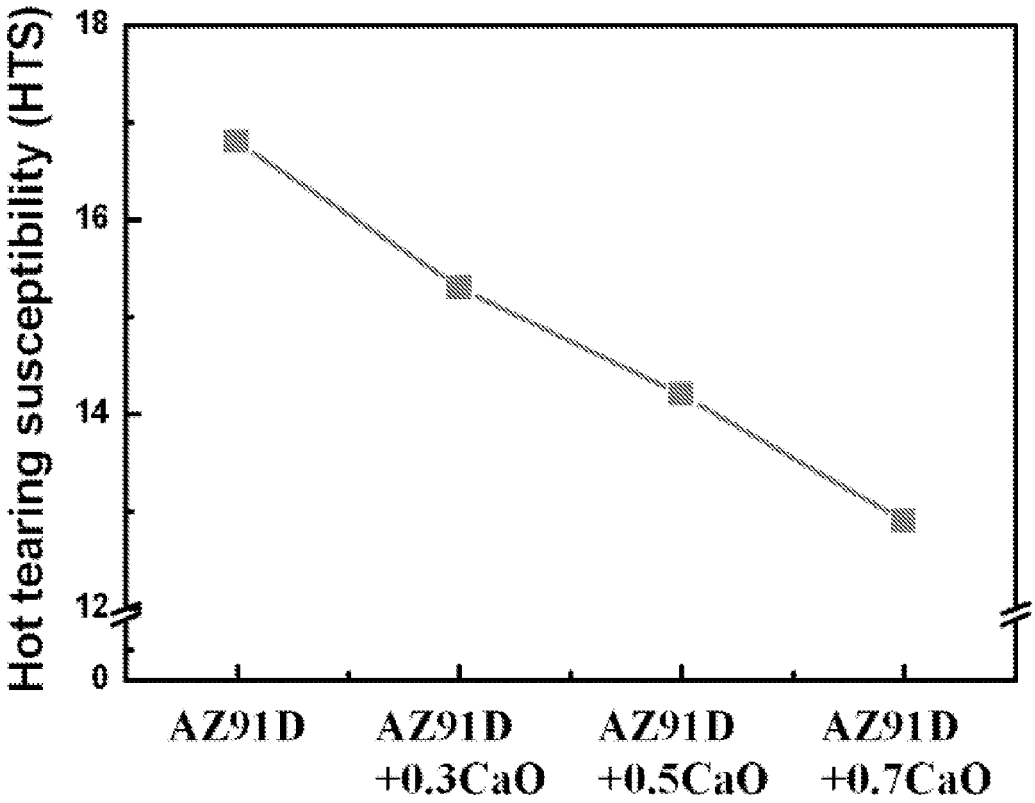
FIG. 23 is a graph showing HTS of alloys prepared by adding 0.3 wt %, 0.5 wt % and 0.7 wt % of CaO into AZ91D.

FIG. 23 is a graph showing HTS of Mg alloys prepared by adding 0.3 wt %, 0.5 wt % and 0.7 wt % of CaO into AZ91D. It can be confirmed that HTS is lower as an added amount of CaO is greater.

As described above, the present invention can solve typical problems caused by the addition of Ca because a new Mg-based alloy is manufactured by adding CaO into a molten magnesium alloy. Also, it is possible to prevent the deterioration of fluidity, die soldering and hot-tearing, which are caused by directly adding alkaline earth metal, and also prevent.

Furthermore, by virtue of stability of an alkaline earth metal oxide added during the manufacture of a magnesium-based alloy, the intrusion of foreign substances into a melt can be prevented, thereby improving the internal soundness of a magnesium alloy. Consequently, physical properties of the magnesium alloy thus manufactured can be improved.

While the present invention has been particularly shown and described with reference to preferred embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A method of manufacturing a magnesium-based alloy, the method comprising:

providing a melt by melting magnesium or magnesium alloy;

applying an alkaline earth metal oxide on a surface of the melt;

exhausting the alkaline earth metal oxide proximate the surface of the melt through a reduction reaction between the melt and the applied alkaline earth metal oxide; and reacting an alkaline earth metal produced by the exhaustion of the alkaline earth metal oxide with the magnesium, or an alloy element of the magnesium alloy, or both;

wherein an oxygen component of the alkaline earth metal oxide is substantially removed from the surface of the melt by stirring an upper layer portion of the melt.

2. The method of 1, wherein the reduction reaction of the alkaline earth metal oxide generates a flint flash, and wherein the exhausting of the alkaline earth metal oxide further comprises performing the reduction reaction at least until the flint flash disappears.

3. The method of claim 1, wherein the alkaline earth metal produced by the exhaustion of the alkaline earth metal oxide forms an intermetallic compound together with magnesium, aluminum, and other alloy elements.

4. The method of claim 1, wherein the alkaline earth metal oxide is in a form of powders having a particle size of 0.1 to 200 μm to accelerate the reaction with the melt.

5. The method of claim 1, wherein an added amount of the alkaline earth metal oxide is 0.01 to 30.0% by weight.

6. The method of claim 5, wherein the alkaline earth metal oxide comprises calcium oxide.

7. The method of claim 1, wherein the melt is substantially free of the alkaline earth metal as a result of the reaction between the alkaline earth metal and the magnesium, or an alloy element of the magnesium alloy, or both.

8. The method of claim 1, wherein the oxygen component removed from the surface of the melt is removed in a form of oxygen gas ($O_2$) or removed in a form of dross after being combined with the magnesium of the melt.

9. The method of claim 1, wherein the stirring is performed at the upper layer portion of the melt, the upper layer portion having a depth from the surface thereof, the depth of the upper layer portion being no more than 20% of a total depth of the melt.

10. The method of claim 9, wherein the depth of the upper layer portion is about 10% of the total depth of the melt.

11. The method of claim 10, wherein the stirring is performed in a state where the surface of the melt is exposed to air.

12. A method of manufacturing a magnesium-based alloy, the method comprising:

providing a melt by melting magnesium or magnesium alloy;

applying an alkaline earth metal oxide on a surface of the melt;

stirring the melt including the alkaline earth metal oxide on the surface;

exhausting an alkaline earth metal oxide introduced into the melt through reduction reaction between the melt and the alkaline earth metal oxide;

allowing an alkaline earth metal produced by the exhaustion of the alkaline earth metal oxide to react with the magnesium, or an alloy element of the magnesium alloy, or both; and removing an alkaline earth metal oxide remaining after the reaction together with dross.

13. A method of improving melt fluidity and hot-tearing resistance of a magnesium alloy, the method comprising:

preparing a melt including magnesium or magnesium alloy, or both;

applying an alkaline earth metal oxide on a surface of the melt of the magnesium or magnesium alloy; and improving the melt fluidity and hot-tearing resistance of the magnesium alloy by reducing the alkaline earth metal oxide applied on the melt, wherein an oxygen component of the alkaline earth metal oxide is substantially removed from the surface of the melt by stirring an upper layer portion of the melt.

14. The method of claim 13, wherein the applied alkaline earth metal oxide is CaO with a weight corresponding to 1.4-1.7 times a target weight of Ca in a final magnesium alloy.

15. The method of claim 14, wherein the applying of the alkaline earth metal oxide on the melt is characterized in that the alkaline earth metal oxide is reduced in the upper layer portion of which a depth is about 10% of a total depth of the melt from the surface thereof.

16. The method of claim 13, wherein the applying of the alkaline earth metal oxide on the melt is performed in a state where the surface of the melt is exposed to air.

17. A method of manufacturing a magnesium-based alloy, the method comprising:

providing a melt including magnesium or magnesium alloy, or both, the melt having an upper layer portion and a lower layer portion;

applying an alkaline earth metal oxide on a surface of the melt;

stirring the upper layer portion of the melt to induce a reduction reaction between the melt and the alkaline earth metal oxide near the surface of the melt;

exhausting the alkaline earth metal oxide near the surface of the melt through the reduction reaction between the melt and the alkaline earth metal oxide; and reacting an alkaline earth metal produced by the exhaustion of the alkaline earth metal oxide with magnesium, or an alloy element of the magnesium alloy, or both.

18. The method of claim 17, wherein an added amount of the alkaline earth metal oxide is 0.1 to 0.9% by weight.

19. The method of claim 18, wherein melt fluidity of the magnesium alloy increases in proportion to an added amount of the alkaline earth metal oxide.

20. The method of claim 19, wherein the melt fluidity is measured by a length of a cast product which is produced in a spiral mold.

21. The method of claim 18, wherein hot-tearing resistance of the magnesium alloy increases in proportion to an added amount of the alkaline earth metal oxide.

22. The method of claim 21, wherein the hot-tearing resistance of the magnesium alloy is measured by calculating hot-tearing susceptibility (HTS).

* * * * *